US009463941B2

(12) United States Patent
Mori

(10) Patent No.: US 9,463,941 B2
(45) Date of Patent: Oct. 11, 2016

(54) SHEET SKEW FEEDING CORRECTION DEVICE AND IMAGE FORMING APPARATUS

(71) Applicant: CANON KABUSHIKI KAISHA, Tokyo (JP)

(72) Inventor: Hideki Mori, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/944,377

(22) Filed: Nov. 18, 2015

(65) Prior Publication Data

US 2016/0176667 A1 Jun. 23, 2016

(30) Foreign Application Priority Data

Dec. 17, 2014 (JP) ..... 2014-254695

(51) Int. Cl.

| | |
|---|---|
| ***B65H 9/04*** | (2006.01) |
| ***B65H 9/06*** | (2006.01) |
| ***B65H 9/14*** | (2006.01) |
| ***B65H 5/06*** | (2006.01) |

(52) U.S. Cl.

CPC ..... *B65H 9/06* (2013.01); *B65H 5/062* (2013.01); *B65H 9/14* (2013.01); *B65H 2404/722* (2013.01); *B65H 2404/725* (2013.01); *B65H 2404/7231* (2013.01); *B65H 2511/13* (2013.01)

(58) Field of Classification Search

CPC .... B65H 9/06; B65H 9/14; B65H 2404/722; B65H 2404/7231; B65H 2404/725

USPC ..... 271/242

See application file for complete search history.

(56) References Cited

U.S. PATENT DOCUMENTS

| | | | | |
|---|---|---|---|---|
| 6,011,948 | A * | 1/2000 | Amano | B65H 9/06 271/245 |
| 6,473,576 | B1 | 10/2002 | Koshimizu et al. | |
| 6,522,862 | B2 | 2/2003 | Koshimizu et al. | |
| 6,733,008 | B2 * | 5/2004 | Waragai | B65H 5/06 271/242 |
| 7,731,175 | B2 * | 6/2010 | Kang | B41J 11/009 271/110 |

(Continued)

FOREIGN PATENT DOCUMENTS

| | | | |
|---|---|---|---|
| JP | 07-309481 | A | 11/1995 |
| JP | 2849329 | B2 | 1/1999 |

(Continued)

*Primary Examiner* — Howard Sanders

(74) *Attorney, Agent, or Firm* — Fitzpatrick, Cella, Harper & Scinto

(57) ABSTRACT

A sheet skew feeding correction device has a controller that performs a first mode in which the leading end of the sheet conveyed by the first conveying portion abuts the sheet stopping portion in the first posture, and the sheet is nipped by the second conveying portion operating to convey the sheet while the sheet moves the sheet stopping portion toward the second posture against the urging force of the urging portion and performs a second mode in which the leading end of the sheet conveyed by the first conveying portion abuts the sheet stopping portion in the first posture, the sheet moves the sheet stopping portion against the urging force of the urging portion, and the leading end of the sheet abuts the nip portion of the stopped second sheet conveying portion so that a loop shape is formed in the sheet.

13 Claims, 28 Drawing Sheets

(56) References Cited

U.S. PATENT DOCUMENTS

| | | | | |
|---|---|---|---|---|
| 8,109,507 | B2 * | 2/2012 | Okumura | B65H 9/006 271/227 |
| 8,348,265 | B2 * | 1/2013 | Isogai | B65H 9/006 271/227 |
| 8,382,099 | B2 | 2/2013 | Mori | |
| 8,919,771 | B2 | 12/2014 | Mori | |
| 2005/0191101 | A1 * | 9/2005 | Ahn | G03G 15/6564 399/388 |
| 2012/0093554 | A1 * | 4/2012 | Suzuki | B65H 7/02 399/381 |
| 2015/0115526 | A1 * | 4/2015 | Harada | B65H 5/062 271/228 |

FOREIGN PATENT DOCUMENTS

| | | | |
|---|---|---|---|
| JP | 2011-190026 | A | 9/2011 |
| JP | 5455723 | B2 | 3/2014 |

* cited by examiner

SHEET SKEW FEEDING CORRECTION DEVICE AND IMAGE FORMING APPARATUS

BACKGROUND OF THE INVENTION

1. Field of the Invention

The present invention relates to a sheet skew feeding correction device that performs a skew feeding correction of a conveyed sheet and an image forming apparatus such as a copying machine, a facsimile, and a printer including the sheet skew feeding correction device.

2. Description of the Related Art

A sheet fed from a cassette storing sheets therein may be skew-fed during a feeding/conveying operation due to various reasons in which a conveying roller is formed in a tapered shape or the alignment of the conveying roller is deviated from an image forming portion or a transfer portion.

Particularly, when the sheet is picked up from the cassette or the sheets are separated so that the sheets are not conveyed at the same time, the sheet may be easily skew-fed in that the roller has a narrow width or the roller does not sufficiently hold the sheet in the rotation state.

Thus, in order to obtain a satisfactory output image, there is a need to correct the skew feeding of the sheet before an image is transferred onto the sheet in the image forming portion. Further, it is effective when the correction position is near the image forming portion.

As a method of correcting the skew feeding of the sheet, there is known a general method of correcting the skew feeding by causing a sheet leading end to abut a registration roller nip. However, in the skew feeding correction method of causing the sheet leading end to abut the registration roller nip, a loss time for rotating and stopping the registration roller occurs. For this reason, a gap between the sheets which are conveyed continuously needs to be large. Thus, there is a problem in that the productivity (the number of image forming sheets per unit time) is not easily improved.

Here, although a method is practically used in which the sheet leading end abuts a shutter for the skew feeding correction without stopping the registration roller and the shutter is opened by an actuator, the damage of the sheet generated when the sheet abuts the shutter may be a problem depending on the type of sheet.

In order to solve the above-described problems, Japanese Patent Laid-Open No. 7-309481 discloses a sheet skew feeding correction device that performs a skew feeding correction by causing the sheet leading end to selectively abut any one of the registration roller nip and the shutter in response to the type of sheet.

Further, Japanese Patent Laid-Open No. 2011-190026 discloses a configuration in which the urging force of the shutter urged by a spring is switched two levels in accordance with the forward or backward rotation of the registration motor. According to this configuration, it is possible to minimize a difference in skew feeding correction caused by the different stiffness of the sheet as a big problem in the shutter urged by the spring without any loss time caused by the rotation and the stop of the registration roller.

However, in the related art disclosed in Japanese Patent Laid-Open No. 7-309481, when the sheet leading end abuts the registration roller nip, the sheet may be bitten into the registration roller nip, and hence the skew feeding correction may be not sufficiently performed.

Further, in the related art disclosed in Japanese Patent Laid-Open No. 2011-190026, a drive system that changes the spring pressure by the forward or backward rotation of the registration roller becomes complex, and hence an increase in size and cost of the apparatus occurs. Further, in recent days, the type of sheet demanded by the user increases. As a result, it is difficult to handle the type of sheet demanded by all users by the use of two levels of the urging force.

SUMMARY OF THE INVENTION

It is desirable to provide a sheet skew feeding correction device capable of accurately performing a skew feeding correction in response to the type of sheet without using a complex drive system and an image forming apparatus including the same.

A representative configuration according to the present invention in order to achieve the object is a sheet skew feeding correction device including: a first sheet conveying portion that conveys a sheet; a second sheet conveying portion that is disposed at the downstream of the first sheet conveying portion in a sheet conveying direction and conveys a sheet while nipping the sheet; a moving member that includes a sheet stopping portion located at a position on the upstream of a nip portion of the second sheet conveying portion in the sheet conveying direction so as to stop a leading end of the sheet and is movable between a first posture in which the sheet stopping portion stops the leading end of the sheet conveyed by the first sheet conveying portion and a second posture which allows the passage of the sheet; an urging portion that urges the moving member so that the sheet stopping portion is in the first posture; and a controller that controls the first sheet conveying portion and the second sheet conveying portion, performs a first mode in which the leading end of the sheet conveyed by the first conveying portion abuts the sheet stopping portion in the first posture, and the sheet is nipped by the second conveying portion operating to convey the sheet while the sheet moves the sheet stopping portion toward the second posture against the urging force of the urging portion and a second mode in which the leading end of the sheet conveyed by the first conveying portion abuts the sheet stopping portion in the first posture, the sheet moves the sheet stopping portion against the urging force of the urging portion, and the leading end of the sheet abuts the nip portion of the stopped second sheet conveying portion so that the sheet is formed in a loop shape.

Further features of the present invention will become apparent from the following description of exemplary embodiments with reference to the attached drawings.

DESCRIPTION OF THE EMBODIMENTS

Next, a sheet skew feeding correction device and an image forming apparatus using the same according to embodiments of the invention will be described with reference to the drawings.

First Embodiment

Image Forming Apparatus

Figure 1:
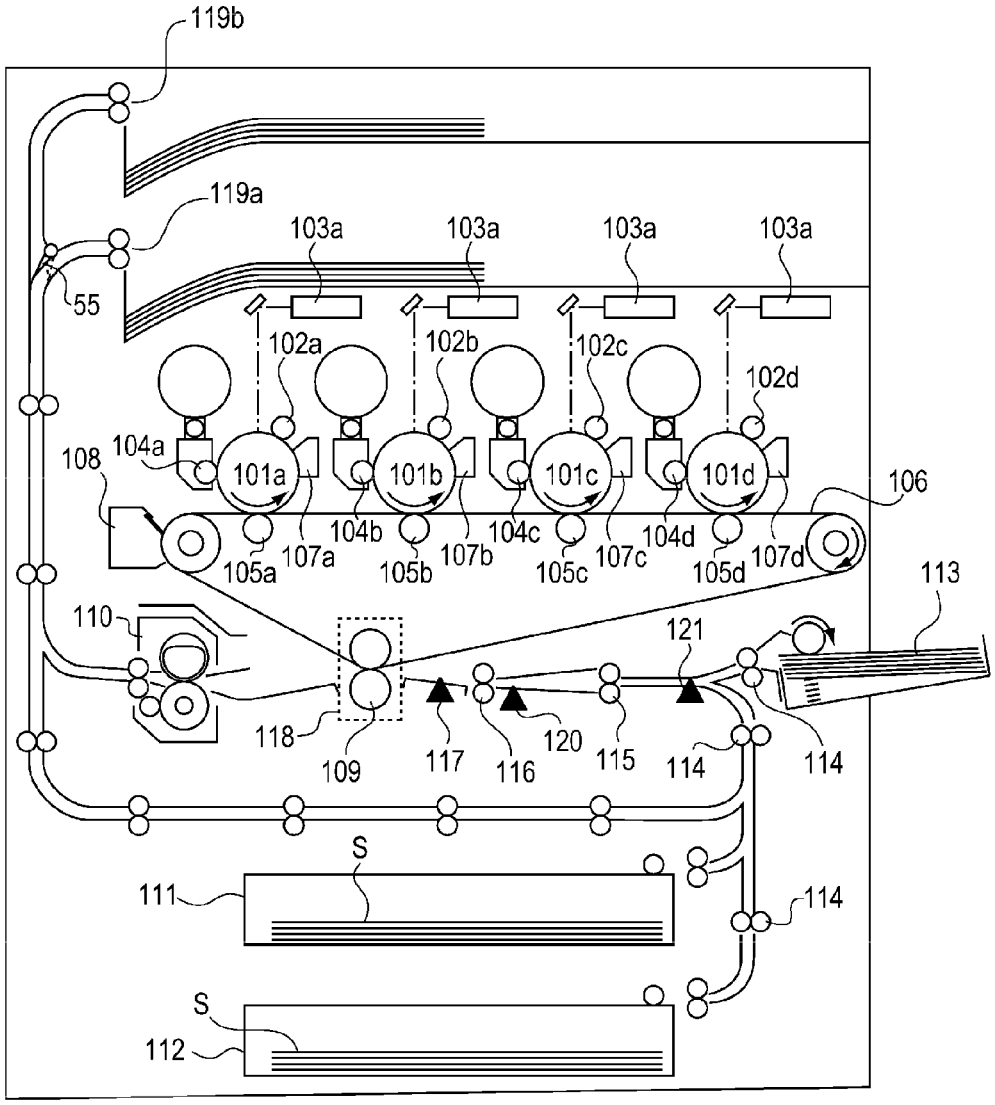
FIG. 1 is a schematic cross-sectional view illustrating an entire image forming apparatus according to an embodiment of the invention.

FIG. 1 is a schematic cross-sectional view illustrating an image forming apparatus including a sheet skew feeding correction device according to a first embodiment.

An image forming apparatus of the embodiment is a color image forming apparatus of an electrophotographic system in which four image forming portions respectively forming yellow, magenta, cyan, and black toner images are disposed in parallel. The image forming portions have the same configuration except that the color of the toner image to be formed is different.

In the image forming portions, photoconductive drums 101*a* to 101*d* are uniformly charged by charging rollers 102*a* to 102*d*, and are exposed in response to the image signals of respective colors from laser scanners 103*a* to 103*d* so that an electrostatic latent image is formed. The electrostatic latent image is developed by development devices 104*a* to 104*d* through yellow toner, magenta toner, cyan toner, and black toner. The toner developed on the photoconductive drums is sequentially transferred onto an endless belt-shaped intermediate transfer belt 106 by primary transfer rollers 105*a* to 105*d*, and hence a full-color toner image is formed on the intermediate transfer belt 106. The toner remaining on the photoconductive drums is collected by drum cleaners 107*a* to 107*d*.

Meanwhile, a sheet S is fed from any one of cassette feeding portions 111 and 112 or a manual feeding portion 113 in synchronization with an image forming operation. The sheet S is conveyed by a conveying roller 114 and is further conveyed toward a registration roller (hereinafter, a "second roller") 116 as a second sheet conveying portion through a front registration roller (hereinafter, a "first roller") 115 as a first sheet conveying portion. The conveying speed of the sheet S at this time is a speed faster than the circumferential speed (the process speed) of the image forming portion, that is, the photoconductive drum or the intermediate transfer belt. In the embodiment, as an example, the process speed of the plain paper is set to 150 mm/s, and the sheet conveying speed thereof is set to 200 mm/s.

When the sheet S is conveyed toward the second roller 116, the skew feeding is corrected by the sheet skew feeding correction device. The configuration and the operation for performing the skew feeding correction will be described below.

After the sheet S of which the skew feeding is corrected by the sheet skew feeding correction device passes by the second roller 116, the leading end of the sheet S is detected by a sheet sensor 117 disposed at a predetermined position in front of a secondary transfer portion 118. Then, a controller calculates a timing in which the conveying speed of the sheet S is decreased to 150 mm/s as the process speed by the second roller 116 so that the leading end of the image formed on the intermediate transfer belt matches the leading end of the sheet S at the secondary transfer portion 118.

The toner image on the intermediate transfer belt 106 is transferred onto the sheet S by a bias voltage applied through a secondary transfer roller 109, and is heated and pressed by a fixing unit 110 so as to be fixed onto the sheet S. Subsequently, the sheet S is discharged to the outside of the apparatus body from a discharging portion 119*a* or 119*b*. Further, the toner remaining on the intermediate transfer belt 106 while not being transferred at the secondary transfer portion 118 is collected by an intermediate transfer cleaner 108.

<Sheet Skew Feeding Correction Device>

Figure 2:
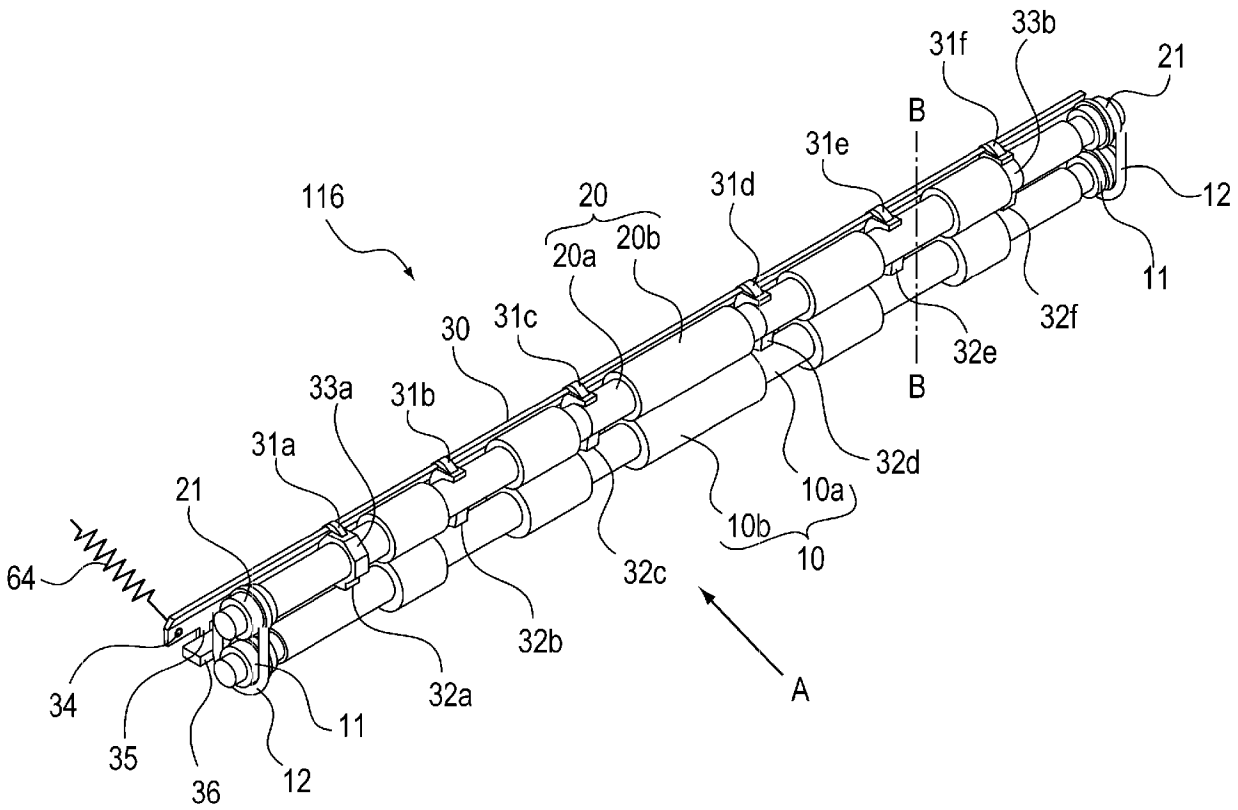
FIG. 2 is a perspective view illustrating a sheet skew feeding correction device according to a first embodiment.
Figure 3:
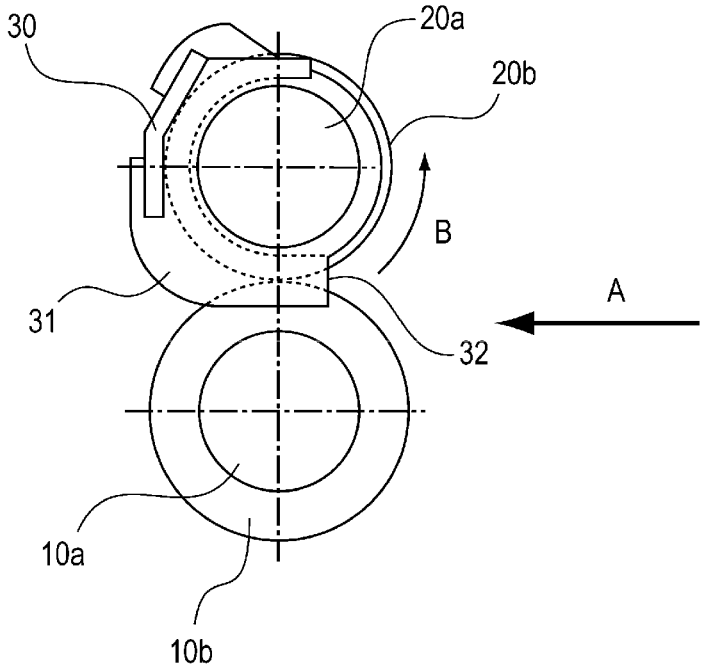
FIG. 3 is a cross-sectional view illustrating the sheet skew feeding correction device according to the first embodiment.

Next, the configuration of the sheet skew feeding correction device that performs the skew feeding correction of the sheet will be described. FIG. 2 is a perspective view illustrating the second roller 116 constituting the sheet skew feeding correction device according to the embodiment, and FIG. 3 is a cross-sectional view taken along the line B-B of FIG. 2.

As illustrated in the drawing, the second roller 116 includes a pair of sheet conveying rotating members including a registration lower roller (hereinafter, a "lower roller") 10 and a registration upper roller (hereinafter, an "upper roller") 20 of which portions near both ends are rotatably supported by bearings 11 and 21. The lower roller 10 and the upper roller 20 are disposed so as to face each other, springs 12 are hooked to the bearings of both ends thereof, and the lower roller 10 and the upper roller 20 are pressed against each other so as to form a nip portion. The second roller 116 is disposed at a position located at the downstream side in the sheet conveying direction (hereinafter, the "downstream side") of the first roller 115 as the first sheet conveying portion and the upstream side in the sheet conveying direction (hereinafter, the "upstream side") of the secondary transfer portion 118.

The lower roller 10 is formed so that a plurality of rubber rollers 10*b* is integrated with a shaft 10*a* in the longitudinal direction. Here, the outer diameter of the rubber roller 10*b* of the embodiment is ϕ16.

In the upper roller 20, a polyacetal roll 20*b* is integrated with a metal shaft 20*a* so as to face the rubber roller 10*b* formed in the lower roller 10. The outer diameter of the roll 20*b* of the embodiment is also ϕ16.

The second roller 116 is provided with a shutter arm (a shutter member) 30 that is rotatable (movable) about the rotation center of the upper roller 20. The shutter arm 30 is provided with a plurality of (in the embodiment, six) semi-circular circular-arc regulation pieces 31 (31*a* to 31*f*) provided in the longitudinal direction of the upper roller 20 (the width direction of the sheet S orthogonal to the sheet conveying direction).

The lower front ends of the regulation pieces 31 are provided with sheet abutting portions (sheet stopping portions) 32 (32*a* to 32*f*) abutting the leading end of the conveyed sheet. Each regulation piece 31 is located between a plurality of nip portions formed by the rubber roller 10*b* and the roll 20*b* and both ends thereof in the longitudinal direction of the second roller 116.

Further, bearings 33*a* and 33*b* are integrated with the regulation pieces 31*a* and 31*f* of both ends, and are rotatably supported by the metal shaft 20*a* of the upper roller 20.

In addition, the regulation piece 31 is disposed at the symmetrical positions about the roller longitudinal direction of the sheet passage path between the upper and lower rollers 10 and 20. Further, the regulation piece 31 is disposed at a plurality of positions so as to handle the sheet S having various widths.

The regulation piece 31 is rotatable between a first posture of stopping the sheet leading end and a second posture of allowing the passage of the sheet while a sheet abutting portion 32 abuts the leading end of the conveyed sheet at a position located at the upstream side of the nip portion of the second roller 116 and in the vicinity of the nip portion.

<Second Roller Driving Mechanism>

Figure 4:
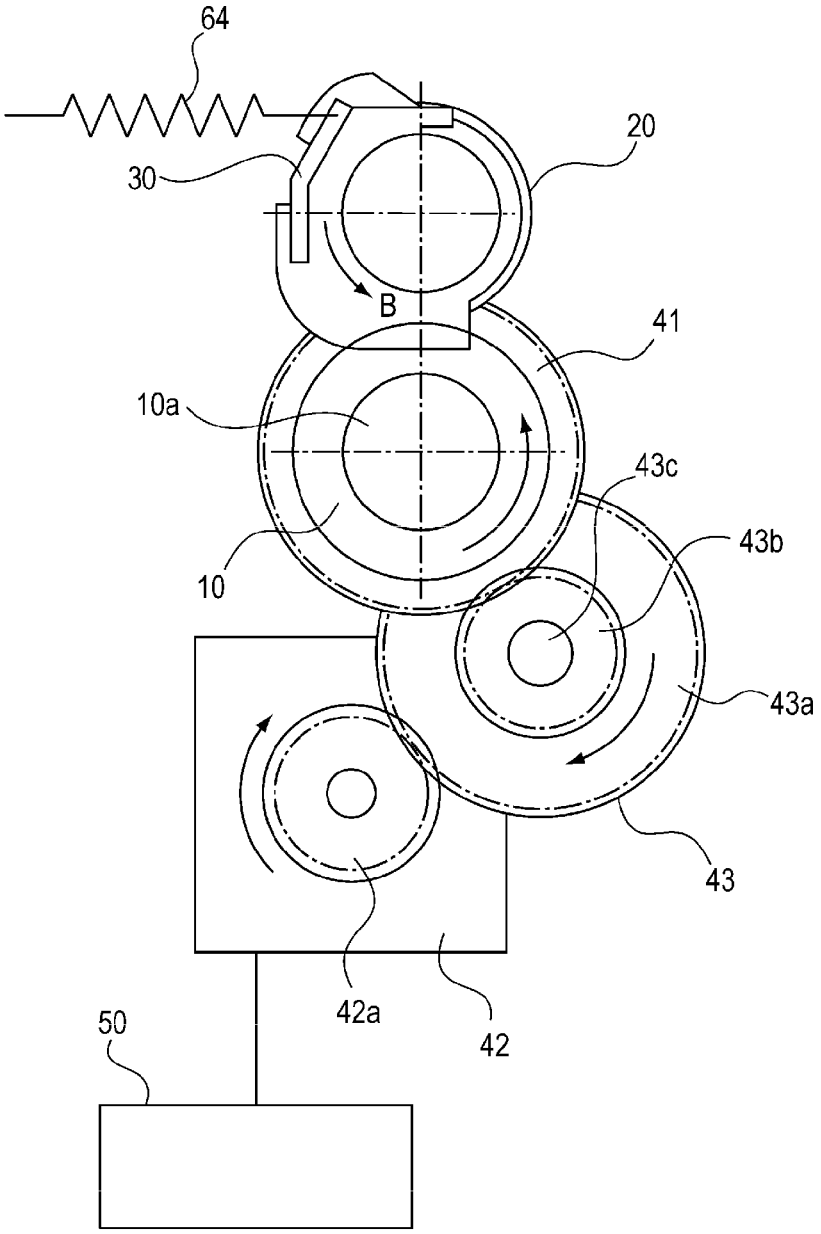
FIG. 4 is a side view illustrating a driving portion of the sheet skew feeding correction device according to the first embodiment.

FIG. 4 is a side view illustrating a mechanism for driving the second roller 116. A drive gear 41 is attached to the shaft 10*a* of the lower roller 10. A motor gear 42*a* is attached to a motor 42 for rotationally driving the lower roller 10. The drive gear 41 and the motor gear 42*a* are connected by an idle gear 43 so as to be driven.

<Shutter Member Urging Structure>

The shutter arm 30 is urged by an urging portion so as to be held in the first posture. Next, a structure of urging the shutter arm 30 will be described.

As illustrated in FIGS. 2 and 4, a spring hook portion 34 and a stopper portion 35 are provided at one end side of the shutter arm 30 in the longitudinal direction, and a tensile coil spring 64 as an urging portion is hooked between the spring hook portion 34 and a frame (not illustrated).

The shutter arm 30 is urged in a counter-clockwise rotation direction (a direction indicated by the arrow B) in FIG. 4 by the spring force of the tensile coil spring 64. Thus, in a state where the sheet is not conveyed by the second roller 116, the stopper portion 35 of the shutter arm 30 abuts a protrusion piece 36 (see FIG. 2) provided in the image forming apparatus body. Then, the sheet abutting portion 32 of each regulation piece 31 is formed so as to be slightly located at the upstream side of the nip portion of the second roller 116 while being perpendicular to the sheet passage path (the first posture of the shutter arm 30 illustrated in FIG. 3).

<Skew Feeding Correction Operation>

Next, the basic skew feeding correction for the sheet will be described.

(Skew Feeding Correction by Shutter)

Figure 5:
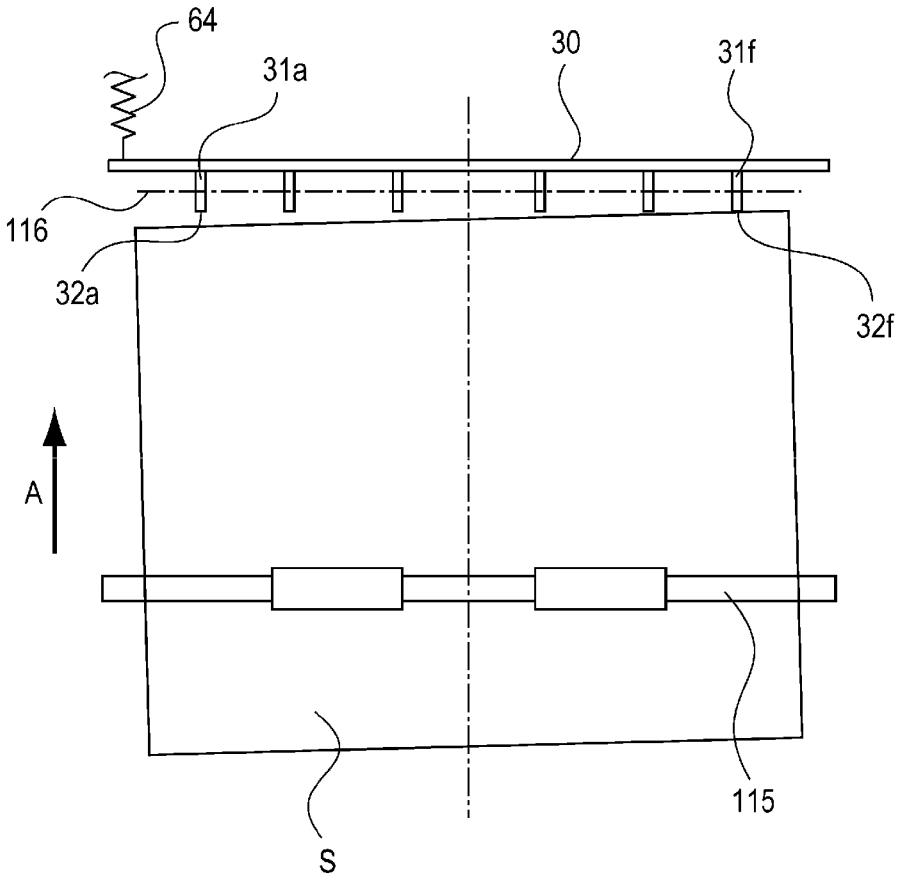
FIG. 5 is an explanatory diagram illustrating a state immediately after the correction of the sheet skew feeding correction device starts in a first mode.
Figure 6:
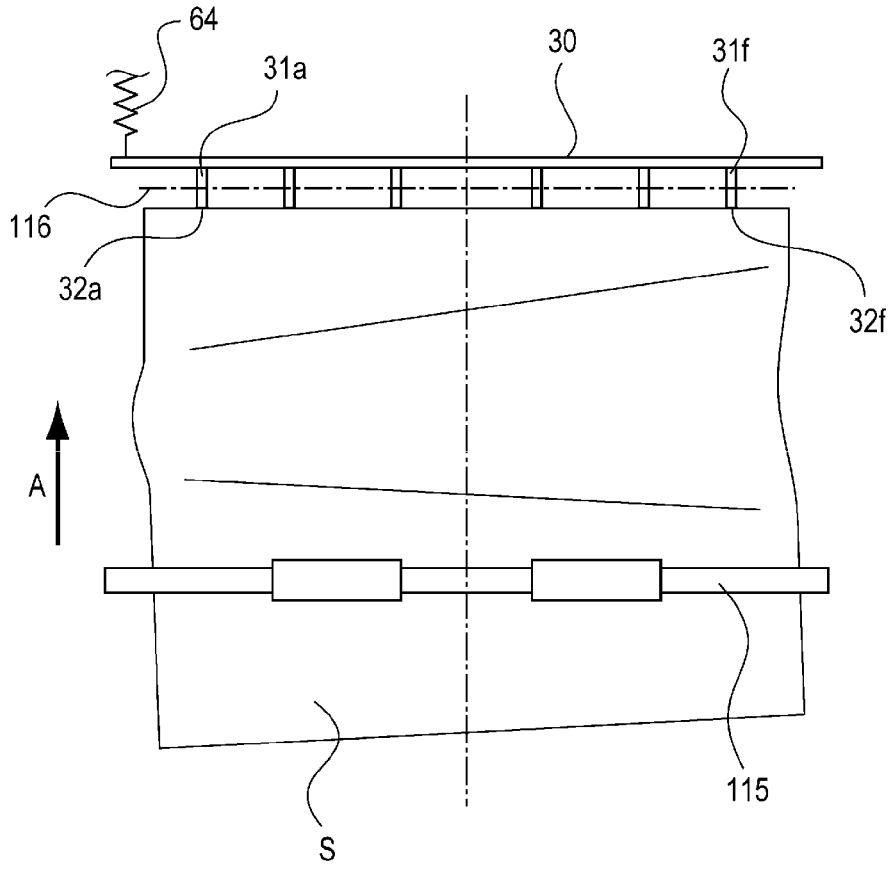
FIG. 6 is an explanatory diagram illustrating a state where the correction of the sheet skew feeding correction device ends in the first mode.

FIGS. 5 and 6 are diagrams in which the sheet S conveyed toward the second roller 116 by the first roller 115 is viewed from the upside of the conveying path. In addition, the rubber roller 10*b* of the lower roller 10 and the roll 20*b* of the upper roller 20 are omitted for the description of FIGS. 5 and 6.

The sheet conveying speed of the first roller 115 and the second roller 116 is set so that the first roller 115 becomes faster by about 1%. This speed difference is set so that the sheet conveying speed of the second roller 116 is not slower than the sheet conveying speed of the first roller 115 due to the component error. Ideally, two rollers may have the same conveying speed.

As illustrated in FIG. 5, when the sheet S is conveyed in a skew feeding state in the sheet width direction (a direction orthogonal to the sheet conveying direction A) with respect to the second roller 116, the right leading end of the sheet S in the width direction first abuts the sheet abutting portion 32*f* of the right regulation piece 31*f* of FIG. 5.

At this time, since the tensile coil spring 64 is hooked to the shutter arm 30 holding the regulation piece 31*f*, the sheet S cannot rotate the regulation piece 31 and the shutter arm 30 against the urging force of the tensile coil spring 64. Accordingly, in this state, the sheet S is formed in a loop shape while the forward movement of the sheet is disturbed at a portion abutting the regulation piece 31*f*.

Meanwhile, at this time, since the sheet S is conveyed in the skew feeding state, the sheet S does not abut the sheet abutting portion 32*a* of the left regulation piece 31*a* of FIG. 5.

Accordingly, one side (the left side of FIG. 5) not abutting the regulation piece 31*a* in the sheet S is continuously conveyed by the first roller 115. As a result, as illustrated in FIG. 6, the sheet S also abuts the sheet abutting portion 32*a* of the left regulation piece 31*a* not abutting the sheet S so far.

In this state, both sheet abutting portions 32*a* and 32*f* of the regulation pieces 31*a* and 31*f* provided near both ends of the sheet S abut the sheet S. Then, since the pressing force of the sheet S becomes superior to the urging force of the tensile coil spring 64, all regulation pieces 31 are pressed. In this state, the regulation piece 31 and the shutter arm 30 first rotate about the shaft 20*a* of the upper roller 20 as the rotation center of the shutter arm (the second posture of the shutter member).

In this state, since both ends of the leading end of the sheet S in the sheet width direction abut the sheet abutting portions 32 of the regulation pieces 31, both ends are located at the same position in the sheet conveying direction, that is, the skew feeding is corrected. When the regulation piece 31 and the shutter arm 30 rotate, any barrier for the sheet S disappears. Thus, the sheet is conveyed again so as to enter the nip portion of the second roller 116 while the skew feeding is corrected.

The sheet S entering the nip portion of the second roller 116 is conveyed toward the secondary transfer portion 118 while the skew feeding correction state is maintained. In addition, there is a need to convey the sheet subjected to the skew feeding correction by the second roller 116 in this state. For this configuration, it is desirable to dispose the sheet abutting portion 32 so that the sheet abutting portion 32 abutting the sheet leading end is located near the nip portion of the second roller 116 when the shutter member is located at the first posture.

(Skew Feeding Correction by Nip Portion of Second Roller)

Figure 7:
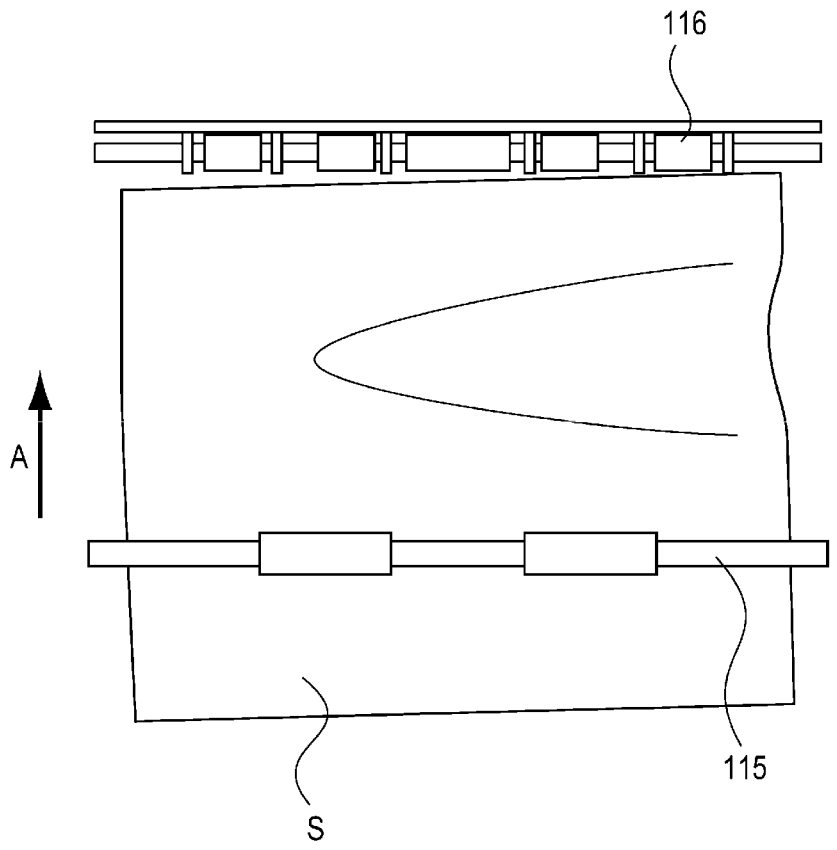
FIG. 7 is an explanatory diagram illustrating a state immediately after the correction of the sheet skew feeding correction device starts in a second mode.
Figure 8:
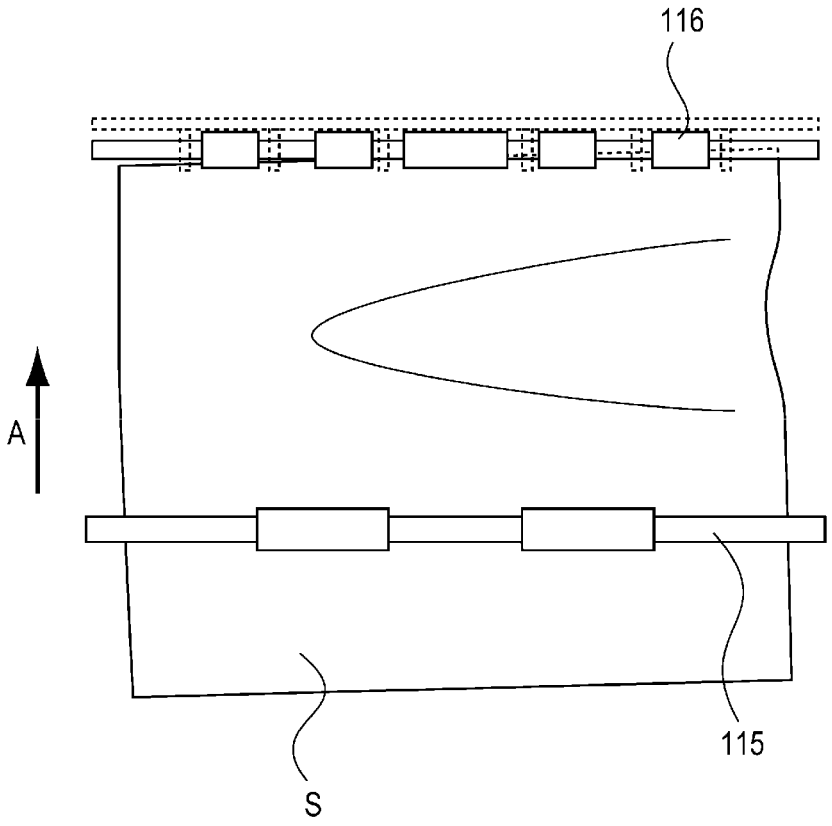
FIG. 8 is an explanatory diagram illustrating a state where the correction of the sheet skew feeding correction device is performed in the second mode.
Figure 9:
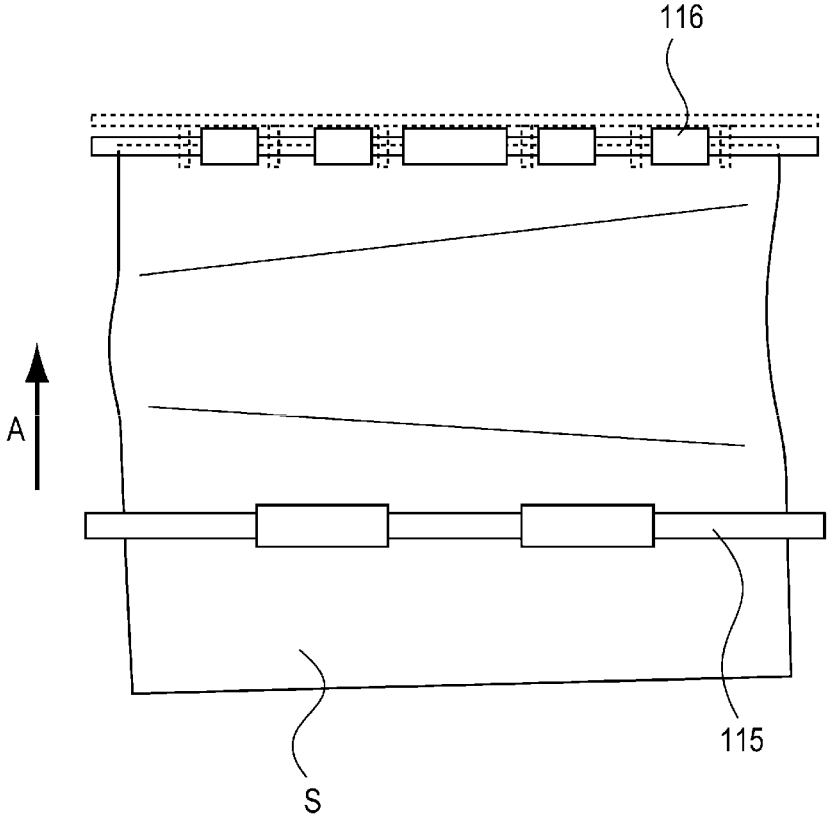
FIG. 9 is an explanatory diagram illustrating a state where the correction of the sheet skew feeding correction device ends in the second mode.

FIGS. 7 to 9 are diagrams in which the sheet S conveyed to the second roller 116 by the first roller 115 is viewed from the upside of the conveying path.

As illustrated in FIG. 7, when the sheet S is conveyed to the stopped second roller 116 in the skew feeding state in the sheet width direction (a direction orthogonal to the sheet conveying direction A), the right leading end of the sheet S in the width direction abuts the right end of the right roller nip in the width direction.

Meanwhile, at this time, since the sheet S is conveyed in the skew feeding state, the sheet S does not abut the left end of the left roller nip in the width direction of FIG. 7.

Due to the controller 50, the sheet S is continuously conveyed by the first roller 115 after a predetermined time elapses from the time point in which the sheet leading end of the sheet S passes by a sheet sensor 120 (see FIG. 1) disposed at the upstream side of the second roller 116. As a result, as illustrated in FIGS. 8 and 9, the sheet S forms a loop between the first roller 115 and the second roller 116, and the sheet S also abuts the left end of the left roller nip not abutting the sheet S so far in the width direction.

Subsequently, the second roller 116 starts to rotate, and is conveyed toward the secondary transfer portion 118 while the skew feeding is corrected.

<Description of Print Job and Skew Feeding Correction Mode Switching Operation>

Next, a skew feeding correction mode switching operation in response to the type of sheet (hereinafter, a "sheet type") will be described. The image forming apparatus of the embodiment switches two modes by the thickness of the sheet as the skew feeding correction method. The first mode is a mode (hereinafter, a "thin sheet mode") which is used when a thin sheet having a small basis weight is subjected to the skew feeding correction so that the sheet leading end is evenly adjusted by the urging force of the shutter arm 30. The second mode is a mode (hereinafter, a "thick sheet mode") which is used when a thick sheet having a large basis weight is subjected to the skew feeding correction so that the sheet leading end is evenly adjusted by the nip portion of the second roller 116 after the skew feeding correction is performed by the shutter arm 30.

As described above, since the operation in which the sheet S rotates the regulation piece 31 and the shutter arm 30 is performed by the stiffness of the sheet S, the behavior is different in the sheets having a different basis weight.

That is, a force of rotating the regulation piece 31 and the shutter arm 30 is relatively small in a sheet (hereinafter, a "plain paper") having a small basis weight. For that reason, when the urging force of the shutter arm 30 is too strong, the sheet is buckled or folded. Here, it is desirable that the urging force of the shutter arm 30 be about 2 to 3 N in the case of the plain paper.

Meanwhile, a force of rotating the regulation piece 31 and the shutter arm 30 is relatively large in a sheet (hereinafter, a "thick sheet") having a large basis weight. For that reason, when the urging force of the shutter arm 30 is too weak, the regulation piece 31 and the shutter arm 30 rotate before the entire leading end of the sheet S conveyed in the skew feeding state abuts the regulation piece 31, and hence the skew feeding correction cannot be sufficiently performed.

Figure 10:
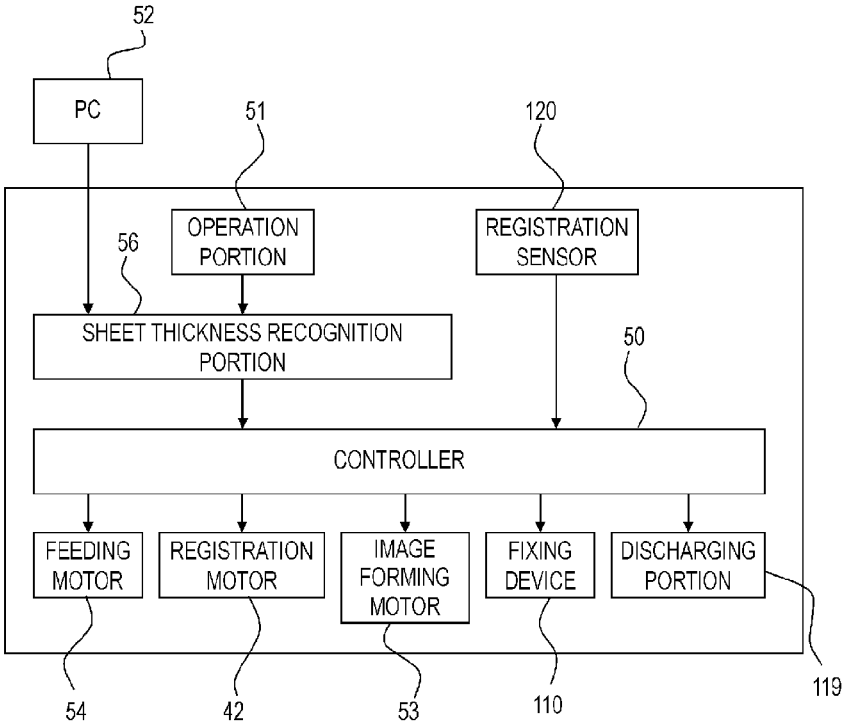
FIG. 10 is a control block diagram illustrating an image forming apparatus according to the first embodiment.
Figure 11:
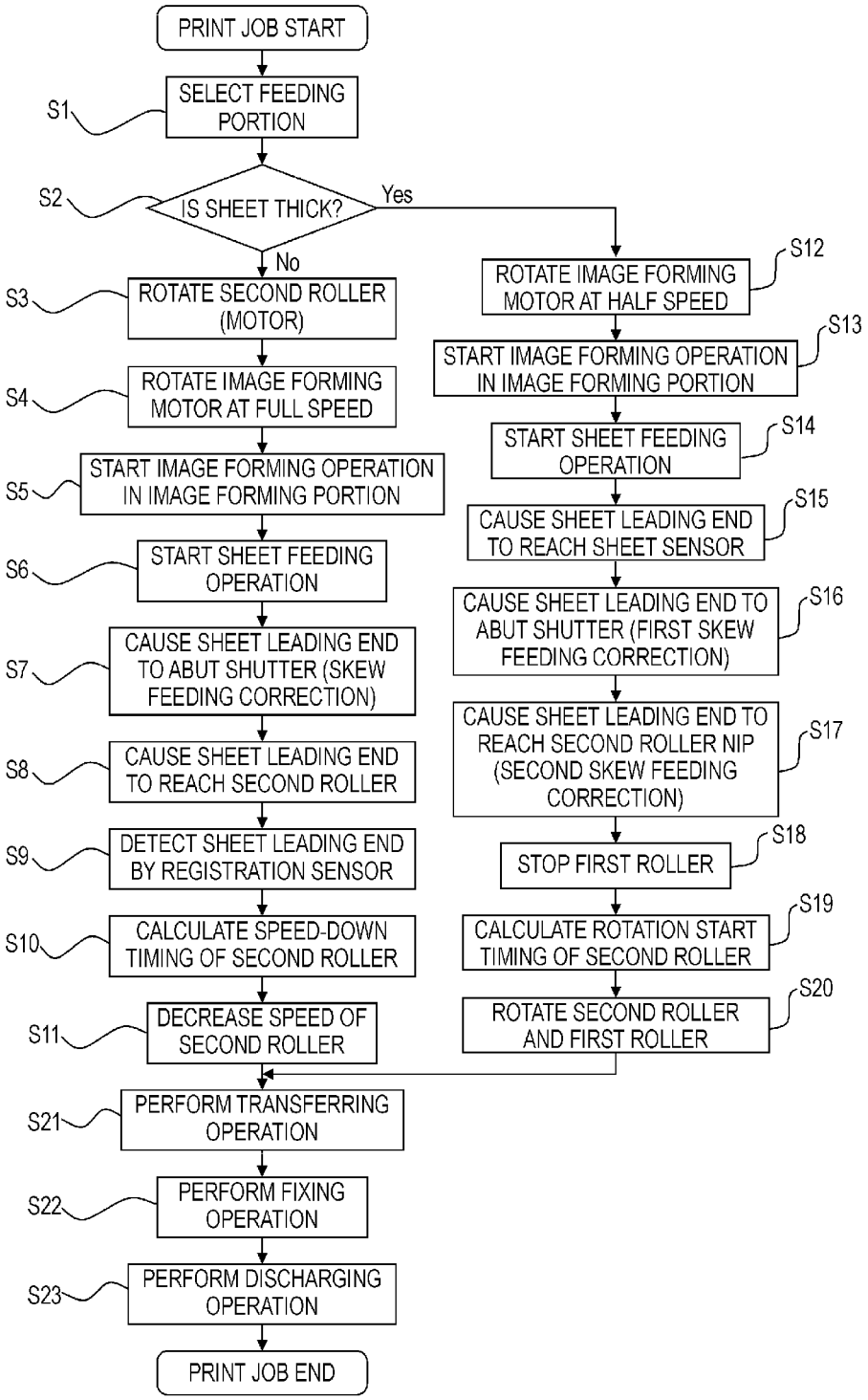
FIG. 11 is a flowchart illustrating a main print job of the image forming apparatus according to the first embodiment.

FIG. 10 is a control configuration block diagram of the image forming apparatus according to the embodiment, and FIG. 11 is a flowchart illustrating a schematic print job. The operation of the image forming apparatus will be described with reference to FIGS. 10 and 11.

As illustrated in FIG. 10, the controller of the embodiment inputs the thickness of the sheet recognized by the selection of the sheet cassette from a sheet thickness recognition portion 56 based on the instruction from an operation portion 51 or a PC 52. Further, the controller 50 inputs detection signals from various sensors such as the sheet sensor 120 disposed at the upstream side of the second roller 116. Then, the controller 50 drives a feeding motor 54 driving the conveying roller 114, a registration motor 42 driving the second roller 116, and motors 53 driving the image forming portions such as the photoconductive drum 101 in response to the above-described signals. Further, the controller controls the driving of the fixing unit 110 or the discharging portion 119 (119*a*, 119*b*).

In the image forming apparatus of the embodiment controlled by the controller, as described above, the process speed is 150 mm/s when the sheet is the plain paper, and the sheet conveying speed to be decreased to the process speed to the front position of the secondary transfer portion 118 is 200 mm/s. Further, the process speed of the thick sheet and the sheet conveying speed to be decreased to the process speed at the front position of the secondary transfer portion 118 are respectively 75 mm/s and 100 mm/s as ½ of the plain paper.

In the image forming apparatus, the sheet type set in advance is registered by the operation portion 51 or the like from a user.

For example, a plain paper having a basis weight of 80 $g/m^2$ is set in the cassette feeding portions 111 and 112 of FIG. 1, and a thick sheet having a basis weight of 209 $g/m^2$ is set in the manual feeding portion 113.

A print job is performed by the PC 52 directly connected to the image forming apparatus or connected thereto via a network. At this time, the sheet to be used is selected from the cassette feeding portions 111 and 112 and the manual feeding portion 113 (hereinafter, the "feeding portion") along with the number of copies (S1).

The image forming apparatus determines whether the sheet type set by the selection of the feeding portion such as the cassette is the plain paper or the thick sheet based on the preliminarily registered information (S2).

(Plain Paper)

When the feeding portion having the plain paper set therein is selected, the controller 50 rotates the registration motor 42 so that the second roller 116 rotates at a full speed (in the embodiment, a sheet conveying speed of 200 mm/s) in the sheet conveying direction (S3).

The controller 50 rotates the registration motor 42 and sets the speed of the motors 53 driving the image forming portions such as the photoconductive drum 101, the intermediate transfer belt 106, and the developing sleeve 104 so that the circumferential speed becomes a predetermined process speed (S4). That is, in the embodiment, the image forming portions such as the photoconductive drum 101, the intermediate transfer belt 106, and the developing sleeve 104 are driven at the circumferential speed of 150 mm/s (S4).

After the speed of the registration motor 42 and the motor 53 driving the image forming portion is set, the image forming operation is started (S5).

Further, the feeding motor 54 starts to be driven at a predetermined timing so that the leading end position of the sheet as the transfer target matches the toner image on the intermediate transfer belt 106 by the secondary transfer portion 118, and the sheet starts to be fed from the selected feeding portions 111, 112, and 113 (S6). After the sheet is fed, the sheet is conveyed at the conveying speed (200 mm/s in the case of the plain paper) faster than the speed of the image forming portion.

When the sheet reaches the regulation piece 31 of the shutter arm 30 in the first posture, the skew feeding caused by the above-described operation during the conveying operation is corrected (S7). Subsequently, the shutter member rotates to the second posture so that the sheet passing by the shutter is conveyed to the second roller 116 (S8), and the leading end is detected by the sheet sensor 117 in front of the secondary transfer portion (S9). Then, the controller 50 calculates a timing in which the sheet conveying speed is decreased to the process speed so that the sheet leading end matches the leading end of the toner image on the intermediate transfer belt at the secondary transfer portion (S10), and decreases the registration motor 42 at the timing (S11). That is, when the sheet reaches the sheet sensor 117 slow, the speed-down timing is delayed. On the contrary, when the sheet reaches the sheet sensor 117 fast, the speed-down timing is advanced so that the leading end of the toner image on the intermediate transfer belt matches the sheet in the secondary transfer portion 118.

Subsequently, the toner image on the intermediate transfer belt 106 is transferred onto the sheet by the secondary transfer portion 118 (S21), the toner image is fixed onto the sheet by the heat and the pressure in the fixing unit 110 (S22), and the sheet is discharged from the discharging portion 119 selected by a discharging portion switching portion 55 (S23).

(Thick Sheet)

When the feeding portion having a thick sheet set therein is selected, the controller 50 excites the registration motor 42 so that the second roller 116 is maintained in a stop state.

The controller 50 sets the speed of the motors 53 driving the image forming portions such as the photoconductive drum 101, the intermediate transfer belt 106, and the developing sleeve 104 so that the circumferential speed thereof becomes a predetermined process speed (S12). In the embodiment, the image forming portions such as the photoconductive drum 101, the intermediate transfer belt 106, and the developing sleeve 104 are driven at the circumferential speed of 75 mm/s (S12). After the speed of the registration motor 42 and the motor 53 driving the image forming portion is set, the image forming operation is started (S13).

Further, the feeding motor 54 starts to be driven at a predetermined timing so that the leading end position of the sheet matches the toner image on the intermediate transfer belt 106 by the secondary transfer portion 118, and the sheet starts to be fed from the selected feeding portions 111, 112, and 113 (S14). After the sheet is fed, the sheet is conveyed at the conveying speed (100 mm/s in the case of the thick sheet) faster than the speed of the image forming portion.

After the sheet passes by the sheet sensor 120 disposed at the upstream side of the second roller 116 (S15), the skew feeding caused by the above-described operation in the conveying state is corrected when the sheet reaches the regulation piece 31 of the shutter arm 30 (S16).

However, a force of rotating the shutter arm 30 is relatively large in the thick sheet S having a large basis weight. For that reason, as illustrated in FIGS. 7 and 8, the shutter arm 30 rotates while the skew feeding correction is not sufficient, and the sheet is conveyed toward the nip portion of the second roller 116. Then, when the sheet reaches the nip portion of the second roller 116, the skew feeding correction is performed by the above-described operation (S17).

Next, the controller 50 stops the feeding motor 54 so as to stop the first roller 115 while the skew feeding correction is performed (S18). Then, the controller 50 calculates a timing in which the second roller 116 starts to rotate so that the sheet leading end matches the leading end of the toner image on the intermediate transfer belt 106 by the secondary transfer portion 118 (S19). Then, the second roller 116 and the first roller 115 are rotationally driven at the calculated timing. Thus, the sheet is conveyed to the secondary transfer portion 118 while the skew feeding correction is performed (S20).

Subsequently, the toner image on the intermediate transfer belt 106 is transferred onto the sheet by the secondary transfer portion 118 (S21), the toner image is fixed onto the sheet by the heat and the pressure in the fixing unit 110 (S22), and the sheet is discharged from the discharging portion 119 selected by the discharging portion switching portion 55 (S23).

As described above, in the embodiment, the skew feeding correction modes include the thin sheet mode of evenly adjusting the sheet leading end by the urging force of the shutter arm 30 and the thick sheet mode of evenly adjusting the sheet leading end by the nip portion of the second roller 116 after the skew feeding correction is performed by the shutter arm 30. Since two kinds of skew feeding correction modes are selected in response to the type of sheet, the skew feeding correction can be accurately performed in response to the type of sheet.

Particularly, in the high-stiff sheet such as the thick sheet, the sheet abuts the regulation piece 31 of the shutter arm 30 urged by the tensile coil spring 64 and abuts the nip portion of the stopped second roller 116 so as to perform the skew feeding correction. Thus, since it is possible to prevent the sheet from being bitten into the nip portion of the second roller 116, it is possible to obtain high skew feeding correction ability compared with the case where the skew feeding correction is performed only when the sheet abuts the nip portion of the stopped second roller 116.

Further, since the sheet skew correction is not performed only by the urging force of the shutter arm 30, it is possible to handle the type of sheet having a wide range of thickness (basis weight). Accordingly, the user can obtain the sheet of which the skew feeding correction is sufficiently performed regardless of the type of sheet. Further, in the embodiment, since there is no need to provide a drive system component used when the urging force of the shutter arm 30 is switched by the normal or reverse rotation of the registration motor 42, the image forming apparatus can be decreased in cost and size.

Further, in the embodiment, as illustrated in FIGS. 5 to 9, a case has been described in which the sheet S is skew-fed in the left direction of the sheet width direction. However, it is obvious that the skew feeding correction can be performed in this way even when the sheet S is skew-fed in the direction (the right direction) opposite to the embodiment.

Further, in the embodiment, a case has been described in which the skew feeding correction is performed while being switched between the first mode and the second mode in response to the thickness of the sheet. However, the skew feeding correction mode may be switched based on the basis weight information of the sheet.

Further, in the embodiment, a case has been described in which the process speed of the plain paper or the thick sheet and the urging force of the shutter arm 30 have detailed numerical values, but it is obvious that the invention is not limited to these numerical values.

Further, the image forming apparatus of the electrophotographic system has been exemplarily described. However, it is obvious that the skew feeding correction can be also performed on, for example, an inkjet type image forming apparatus or an image reading device such as an image scanner.

Second Embodiment

A sheet conveying apparatus and an image forming apparatus including the same according to a second embodiment of the invention will be described with reference to FIGS. 12 and 13. In addition, the embodiment has the same basic configuration as the first embodiment, but is different from the first embodiment in that the sheet thickness can be detected by the sheet thickness detection portion and the skew feeding correction control is performed in response to the detection result. Here, only the difference from the first embodiment will be described, and the same reference numeral will be given to the component having the same function as the first embodiment.

<Sheet Skew Feeding Correction Device>

Figure 12:
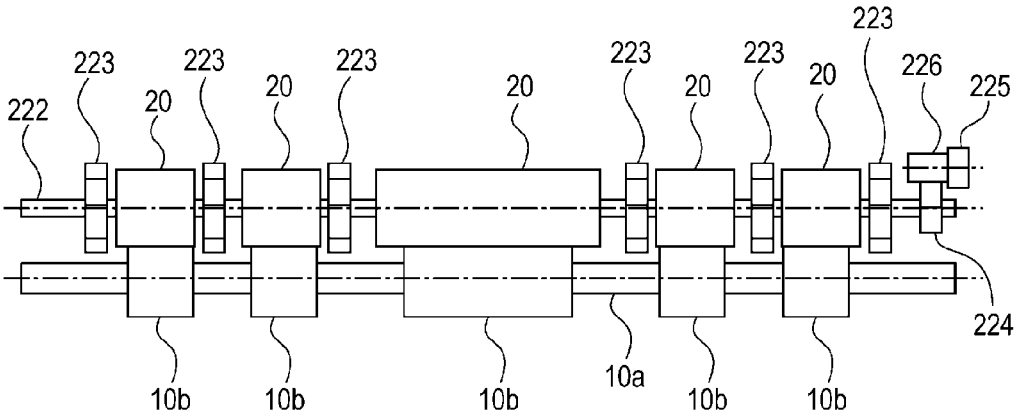
FIG. 12 is a side view illustrating a sheet skew feeding correction device according to a second embodiment.

FIG. 12 is a configuration diagram in which the second roller as the registration roller of the second embodiment is viewed from the downstream side.

A plurality of shutter members 223 is fixed at the same phase (the same positional relation in the rotation direction) with respect to a shutter shaft 222 extending in parallel to the drive shaft 10*a* of the lower roller 10. The shutter shaft 222 as the rotation shaft of the shutter member 223 is rotatably supported by a frame (not illustrated). Each of the rolls 20*b* of the plurality of upper rollers 20 is provided with a communication hole used for the communication therein in the axial direction, and the shutter shaft 222 is inserted into the communication hole of the roll 20*b* of the upper roller 20. Accordingly, the rotation center of the roll 20*b* of the upper roller 20 substantially matches the rotation center of the shutter shaft 222. A shutter cam 224 to be described later is fixed to the shutter shaft 222 at the end of the shutter shaft 222 in the axial direction. The plurality of shutter members 223 and the shutter cam 224 fixed to the shutter shaft 222 rotate along with the shutter shaft 222.

Each of the rolls 20*b* of the plurality of upper rollers 20 is movably supported by a frame (not illustrated), and is provided so as to be urged toward the lower roller 10 by a conveying roll spring (not illustrated) fixed to the frame (not illustrated) in a press-contact state. In a state where the roll 20*b* of the upper roller 20 is urged toward the lower roller 10, a gap is ensured between the outer peripheral surface of the shutter shaft 222 and the inner peripheral surface of the communication hole of the roll 20*b*. For this reason, the spring force of the conveying roll spring (not illustrated) is not transmitted to the shutter shaft 222. Further, the spring force of the conveying roll spring (not illustrated) does not disturb the rotation of the plurality of shutter members 223 and the shutter cam 224 fixed to the shutter shaft 222.

The shutter member 223 is provided with four abutting surfaces 223*a*, 223*b*, 223*c*, and 223*d* provided at the same interval in the rotation circumferential direction so as to serve as the sheet stopping portions stopping the sheet S while abutting the leading end of the sheet S immediately before the sheet S advances to the nip portion of the second roller 116. The abutting surfaces 223*a*, 223*b*, 223*c*, and 223*d* are disposed at the upstream of the nip portion of the second roller 116 before the sheet leading end contacts each abutting surface of the shutter member 223, and stop the leading end of the conveyed sheet.

Next, the shutter cam 224 will be described. The shutter cam 224 is used to position the shutter member 223 in the rotation direction and to set the positions of the abutting surfaces 223*a*, 223*b*, 223*c*, and 223*d* of the shutter member 223 so that the sheet leading end can be stopped. As illustrated in FIG. 13, the shutter cam 224 has a substantially square shape in the side view, and the corner thereof is formed in a circular-arc shape. Then, concave portions 224*a*, 224*b*, 224*c*, and 224*d* are formed on the respective sides of the shutter cam 224.

The shutter cam 224 is pressed by the pressing member 225, and the pressing member 225 is journaled to the frame (not illustrated) so as to be rotatable about the rotation shaft portion. Then, the pressing member 225 is urged toward the shutter cam 224 by a shutter spring 227 of which one end (not illustrated) is fixed to the frame and the other end is attached to the pressing member 225.

Figure 13:
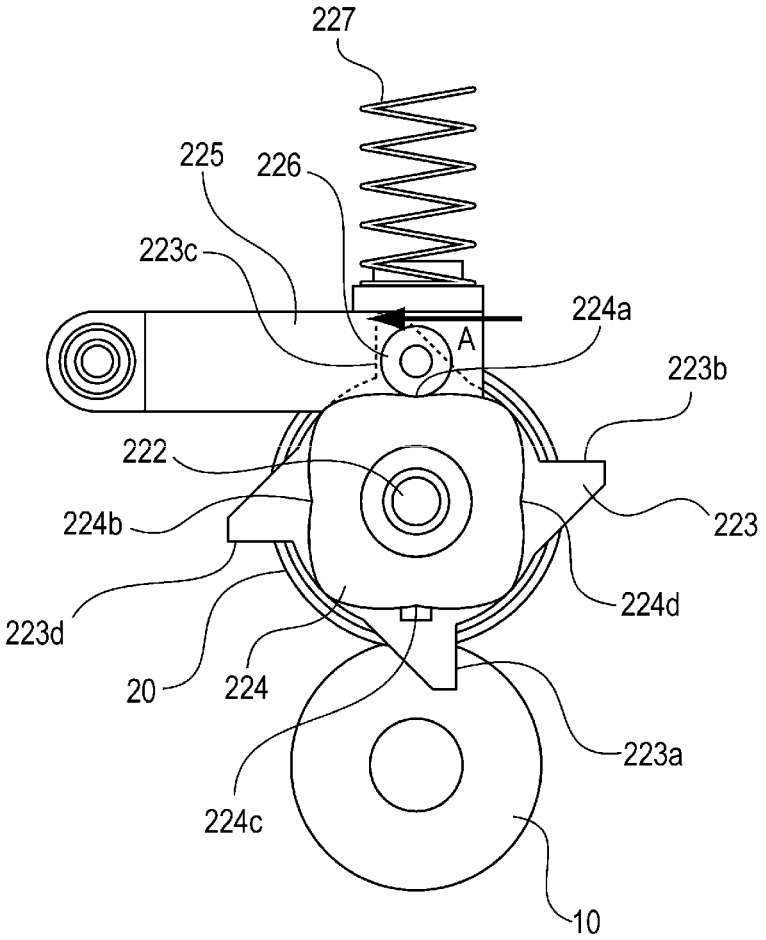
FIG. 13 is a cross-sectional view illustrating the sheet skew feeding correction device according to the second embodiment.

As illustrated in FIG. 13, the front end of the pressing member 225 is provided with a cam follower 226 rotatably journaled to the pressing member 225. The cam follower 226 is provided so as to contact the shutter cam 224 at all times.

With the above-described configuration, when the cam follower 226 urges the shutter cam 224 by the spring force of the shutter spring 227, the shutter member 223 is held at a standby position (in a standby state) in the rotation direction. When the abutting surface 223*a* of the shutter member 223 is located near the nip portion, the cam follower 226 faces the concave portion 224*a* of the shutter cam 224. That is, the cam follower 226 urged by the spring force of the shutter spring 227 presses the concave portion 224*a* of the shutter cam 224. For this reason, the shutter member 223 is held at the standby position by the spring force of the shutter spring 227. That is, a positioning mechanism that positions the shutter member 223 to a normal position is formed by the cam follower 226 urged by the shutter spring 227 or the concave portions 224*a*, 224*b*, 224*c*, and 224*d* of the shutter cam 224.

FIG. 13 illustrates a state where the shutter member 223 is located at the standby position as the sheet leading end stopping posture. When the shutter member 223 is located at the standby position, at least one of the abutting surfaces 223*a*, 223*b*, 223*c*, and 223*d* of the shutter member 223 is located at the upstream position near the nip portion of the second roller 116.

Further, in the embodiment, each of the shutter shaft 222, the shutter member 223, and the shutter cam 224 is formed as a separate member, and the plurality of shutter members 223 and the shutter cam 224 are fixed to the shutter shaft 222. However, the plurality of shutter members 223, the shutter cam 224, and the shutter shaft 222 may be formed as a single molded product by resin.

<Skew Feeding Correction>

Next, the basic skew feeding correction for the sheet will be described.

(Skew Feeding Correction by Shutter)

Similarly to the first embodiment, the sheet conveyed in the skew feeding state abuts any one of the abutting surfaces 223*a* to 223*d* of the shutter member 223, and hence the sheet is formed in a loop shape while the forward movement of the sheet is disturbed.

For example, as illustrated in FIG. 13, the abutting surface 223*a* of the shutter member 223 is positioned at the upstream standby position of the nip portion (the first posture). In this case, when both ends of the sheet S abut the abutting surface 223*a* and the pressing force of the sheet S becomes superior to the urging force of the cam follower 226 pressing the concave portion 224*a* of the shutter cam 224 by the shutter spring 227, the shutter cam 224 rotates (the second posture).

In the case of the plain paper, when the shutter cam 224 rotates in the second posture, the skew feeding of the sheet is corrected, and the sheet is conveyed by the rotating second roller 116. When the sheet S completely passes by the second roller 116, the shutter member 223 rotates so as to face the next concave portion 224*b* of the shutter cam 224 by the force of the shutter spring 227, and hence the abutting surface 223*b* is positioned at the upstream standby position of the nip portion (the first posture).

Meanwhile, in the case of the thick sheet, the skew feeding is corrected while the sheet abuts the shutter member 223, and abuts the nip portion of the stopped second roller 116 similarly to the first embodiment. In this way, the skew feeding of the sheet is corrected.

<Description of Print Job and Skew Feeding Correction Mode Switching Operation>

Next, a skew feeding correction mode switching operation in response to the type of sheet will be described. In the embodiment, the skew feeding correction mode is switched in response to the sheet thickness detected by a sheet thickness sensor 121 provided at the upstream side of the second roller 116 (see FIG. 1) so as to detect the thickness of the sheet other than the configuration in which the sheet thickness is set from the instruction of the operation portion similarly to the first embodiment. In addition, in the embodiment, the sheet thickness sensor 121 is disposed at the downstream side of the merging portion of the sheets conveyed from the feeding portions 111, 112, and 113.

Figure 14A:
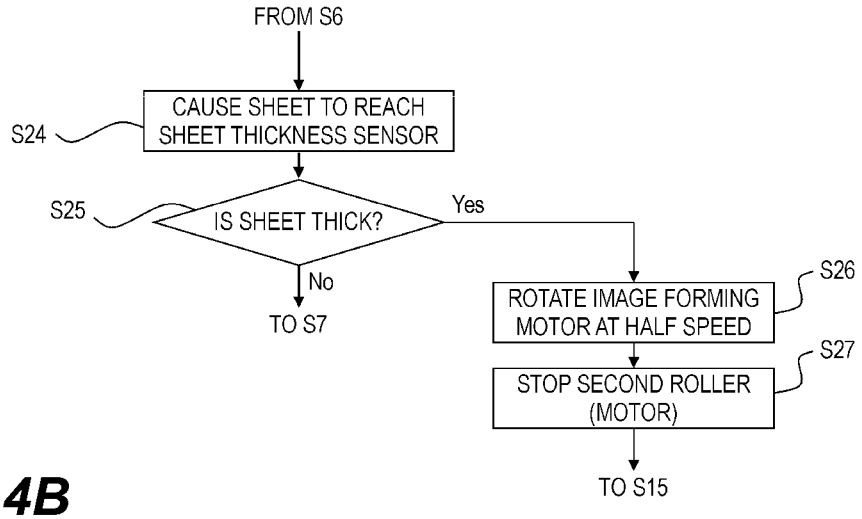
FIGS. 14A and 14B are flowcharts illustrating a main print job of the image forming apparatus according to the second embodiment.
Figure 14B:
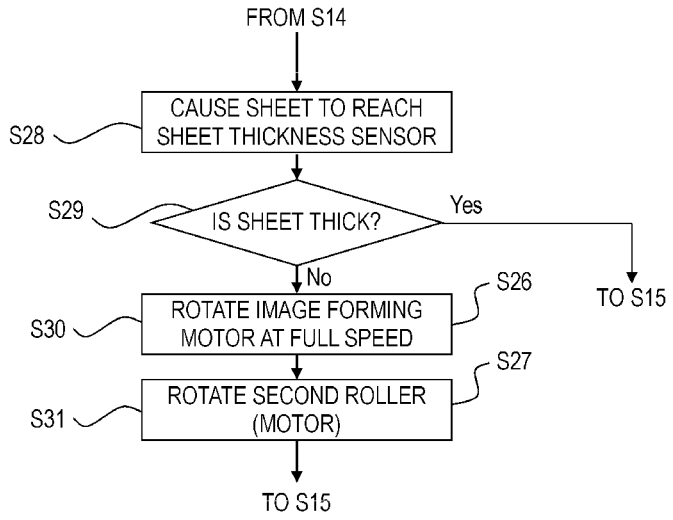
Figure 15:
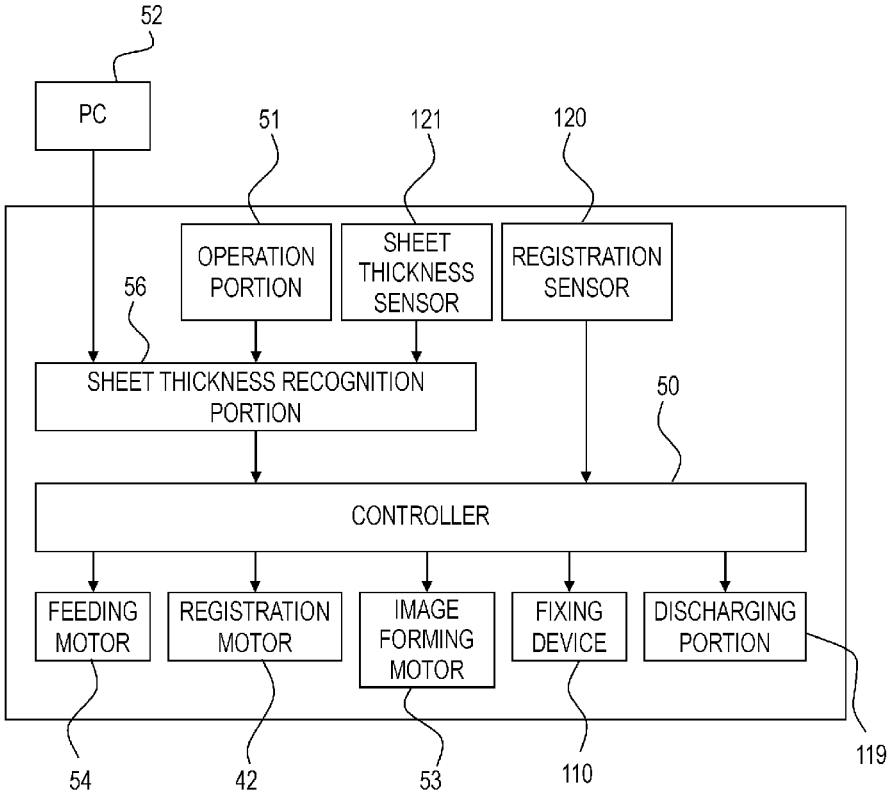
FIG. 15 is a block diagram illustrating the image forming apparatus according to the second embodiment.

FIGS. 14A and 14B are flowcharts illustrating a schematic print job of the image forming apparatus according to the embodiment. Here, only the difference from the flowchart of FIG. 11 is illustrated. FIG. 15 is a block diagram in which the detection signal of the sheet thickness sensor 121 is also input to the sheet thickness recognition portion 56 of FIG. 10 illustrating the control block diagram of the first embodiment.

Referring to FIG. 14A, an operation will be described below when the plain paper is set from the operation portion and the sheet thickness detected by the sheet thickness sensor (the sheet thickness detection portion) indicates the plain paper or the thick sheet.

(Sheet Conveying Operation in case of Plain Paper)

When the sheet S is fed from the feeding portion having a plain paper set therein, the sheet S reaches the sheet thickness sensor 121 after step S6 of FIG. 11 (S24). When it is determined that the sheet S is the plain paper by the detection of the sensor, the routine moves to step S7 of FIG. 11 similarly to the first embodiment.

Meanwhile, when the sheet S is fed from the feeding portions 111, 112, and 113 having a plain paper set therein, the routine proceeds to step S6 of FIG. 11. When it is determined that the sheet is the thick sheet by the sheet thickness sensor 121, the speed of the motor 53 driving the image forming portion is switched to a half speed (S26). Then, the registration motor 42 is stopped (S27), and the routine moves to step S15 of FIG. 11 in order to perform the sheet skew feeding correction in the thick sheet mode.

(Sheet Conveying Operation in case of Thick Sheet)

Next, referring to FIG. 14B, an operation will be described below when the thick sheet is set from the operation portion and the sheet thickness detected by the sheet thickness detection sensor indicates the plain paper or the thick sheet.

When the sheet S is fed from the feeding portions 111, 112, and 113 having a thick sheet set therein, the routine proceeds to step S14 of FIG. 11. Here, when it is determined that the sheet is the thick sheet by the sheet thickness sensor 121, the routine moves to step S15 of FIG. 11 similarly to the first embodiment.

Meanwhile, when the sheet S is fed from the feeding portions 111, 112, and 113 having a thick sheet set therein, the routine proceeds to step S14 of FIG. 11. Here, when it is determined that the sheet is the plain paper by the sheet thickness sensor 121, the speed of the motor 53 driving the image forming portion is switched to a full speed (S30). Further, the registration motor 42 is rotated at a full speed (S31). Then, in order to perform the sheet skew feeding correction in the thin sheet mode, the routine moves to step S7 of FIG. 11.

As described above, in the embodiment, it is possible to switch two kinds of skew feeding correction modes, that is, the thin sheet mode of performing the skew feeding correction by the shutter member 223 and the thick sheet mode of performing the skew feeding correction at the nip portion of the second roller 116 after the correction of the shutter member 223. Thus, it is possible to accurately perform the skew feeding correction in response to the type of sheet. Particularly, when the high-stiff sheet such as the thick sheet abuts the shutter member 223 urged by the shutter spring 227 and abuts the nip portion of the stopped second roller 116, it is possible to prevent a problem in which the sheet is bitten into the nip portion of the second roller 116. For this reason, it is possible to obtain high skew feeding correction ability compared with the case where the skew feeding correction is performed only by the nip portion of the stopped second roller 116.

Further, since the sheet skew correction is not performed only by the urging force of the shutter member 223, it is possible to handle the type of sheet having a wide range of thickness (basis weight). Accordingly, the user can obtain the sheet of which the skew feeding correction is sufficiently performed regardless of the type of sheet. Further, since there is no need to provide a drive system component used when the urging force of the shutter member 223 is switched by the normal or reverse rotation of the registration motor 42, the image forming apparatus can be decreased in cost and size.

Further, it is possible to obtain the sheet in which the skew feeding correction is sufficiently performed even by the user's mistake in which the sheet type different from the sheet type set by the feeding portions 111, 112, and 113 of the apparatus is input compared with the first embodiment.

Third Embodiment

Next, a sheet conveying apparatus and an image forming apparatus including the same according to a third embodiment of the invention will be described with reference to FIG. 16. The embodiment has the same basic configuration as the second embodiment, but the control configuration is different when the plain paper is conveyed while the thick sheet is set. Here, only the difference from the second embodiment will be described, and the same reference numeral will be given to the component having the same function as the second embodiment.

Figure 16:
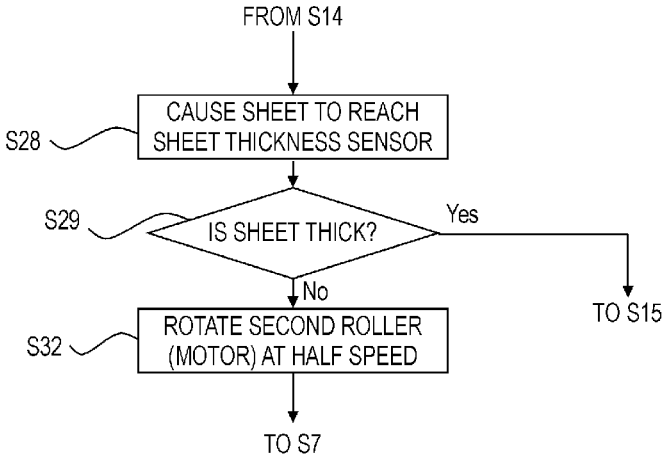
FIG. 16 is a flowchart illustrating a main print job of an image forming apparatus according to a third embodiment.

FIG. 16 is a flowchart illustrating a case where the plain paper is conveyed from the feeding portion when the thick sheet is set in the print job of the image forming apparatus according to the embodiment. Here, only the difference from the flowchart of FIG. 11 is illustrated. In addition, the same operation as the second embodiment is performed when the plain paper is conveyed while the plain paper is set, the thick sheet is conveyed while the plain paper is set, and the thick sheet is conveyed while the thick sheet is set.

When the sheet S is fed from the feeding portions 111, 112, and 113 having a thick sheet set therein, the routine proceeds to step S14 of FIG. 11. Here, when it is determined that the sheet is the plain paper by the sheet thickness sensor 121 (S29), the registration motor 42 is rotated at a half speed (S32). Subsequently, the routine moves to step S7 of FIG. 11.

When the thick sheet is set and conveyed, the motor 53 driving the image forming portion rotates at a half speed in step S12 of FIG. 11. For that reason, even when the plain paper is detected, the second roller is rotated at a half speed so that the sheet conveying speed matches the image forming speed. Thus, the sheet can be directly conveyed to the second roller 116 so as to form an image thereon after the skew feeding correction is performed by the shutter member.

Even when the skew feeding correction control is performed as in the embodiment, the same operation and effect as the second embodiment can be obtained.

Fourth Embodiment

Next, a sheet conveying apparatus and an image forming apparatus including the same according to a fourth embodiment of the invention will be described with reference to FIG. 17. Similarly to the third embodiment, the embodiment has the same basic configuration as the second embodiment, but the control configuration is difference when the plain paper is conveyed while the thick sheet is set. Here, only the difference from the second embodiment will be described, and the same reference numeral will be given to the component having the same function as the second embodiment.

Figure 17:
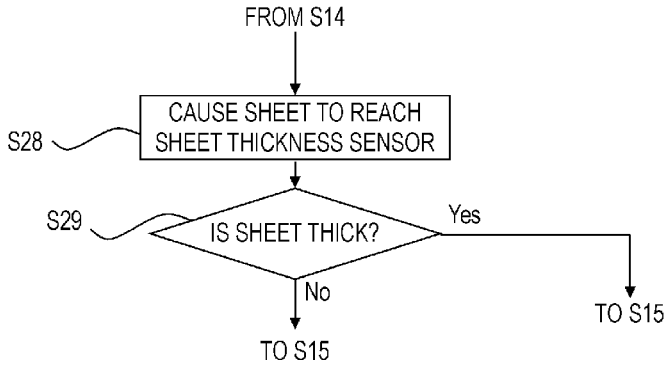
FIG. 17 is a flowchart illustrating a main print job of an image forming apparatus according to a fourth embodiment.

FIG. 17 is a flowchart illustrating a case where the plain paper is conveyed from the feeding portion when the thick sheet is set in the print job of the image forming apparatus according to the embodiment. Here, only the difference from the flowchart of FIG. 11 is illustrated. In addition, the same operation as the second embodiment is performed when the plain paper is conveyed while the plain paper is set, the thick sheet is conveyed while the plain paper is set, and the thick sheet is conveyed while the thick sheet is set.

When the sheet S is fed from the feeding portions 111, 112, and 113 having a thick sheet set therein, the routine proceeds to step S14 of FIG. 11. Here, when it is determined that the sheet is the plain paper by the sheet thickness sensor 121 (S29), the routine moves to step S15 of FIG. 11.

As described above, in the embodiment, the routine proceeds to step S15 similarly to the case where the thick sheet is conveyed even when the plain paper is conveyed while the thick sheet is set. In addition, when the thick sheet is conveyed while the plain paper is set, the routine proceeds to step 26 after step S25 of FIG. 14A, and the skew feeding correction is performed in the thick sheet mode.

In the embodiment, when the thick sheet is conveyed while the plain paper is set, the skew feeding correction in the thick sheet mode is selected. However, even when the plain paper is conveyed while the thick sheet is set, the skew feeding correction is performed in the thick sheet mode. This is because the skew feeding correction needs to be accurately performed in the thick sheet mode in the case of the thick sheet. However, in the case of the plain paper, the skew feeding correction can be accurately performed even in the thick sheet mode. Above all, in this case, the motor 53 driving the image forming portion rotates at a half speed even in the plain paper, and hence the print speed becomes slower than the case where the skew feeding correction is performed in the thin sheet mode.

Even when the skew feeding correction control is performed as in the embodiment, it is possible to obtain the sheet in which the skew feeding correction is sufficiently performed even when there is the user's mistake in which the sheet type is erroneously set. Thus, the same operation and effect as the second embodiment can be obtained.

Fifth Embodiment

Next, a sheet conveying apparatus and an image forming apparatus including the same according to a fifth embodiment of the invention will be described with reference to FIG. 18. The embodiment has the same basic configuration as the first embodiment, but is different from the first embodiment in that the second roller is driven to rotate reversely after the skew feeding correction in the thick sheet mode.

Figure 18:
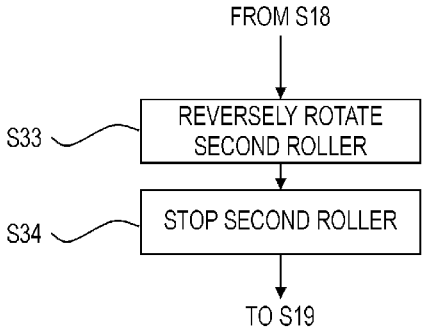
FIG. 18 is a flowchart illustrating a main print job of an image forming apparatus according to a fifth embodiment.

FIG. 18 is a flowchart illustrating a case where a plain paper is conveyed from the feeding portion having a thick sheet set therein in the print job of the image forming apparatus according to the embodiment. Here, only the difference from the flowchart of FIG. 11 is illustrated.

In the embodiment, when the feeding portion having a thick sheet set therein is selected, the routine is the same as the first embodiment until the skew feeding correction of the sheet is performed by the urging force of the shutter arm 30 and the skew feeding correction is performed by the abutting the nip portion of the second roller (step S18 of FIG. 11). Subsequently, in the embodiment, the second roller 116 is reversely driven so as to rotate by a predetermined amount in a direction opposite to the sheet conveying direction (step S33), the sheet leading end bitten into the second roller 116 is ejected toward the upstream side of the second roller nip, and the rotation of the second roller 116 is stopped (S34). Subsequently, the routine proceeds to step S19 of FIG. 11.

As described above, in the case of the thick sheet, the skew feeding correction is first performed by the shutter member and the skew feeding correction is performed by the abutting of the nip portion of the second roller 116. Thus, it is possible to prevent a problem in which the sheet leading end is bitten into the nip portion of the second roller 116. Then, when the second roller 116 is driven to rotate reversely, the sheet bitten into the nip portion of the second roller 116 is ejected to the upstream side of the nip portion of the second roller 116. Thus, it is possible to reliably prevent a problem in which the sheet intrudes into the nip portion of the stopped second roller 116.

In addition, the embodiment illustrates an example in which the configuration of the first embodiment is used as the basic configuration, but it is obvious that the second to fourth embodiments also can be used.

Sixth Embodiment

Next, a sheet conveying apparatus and an image forming apparatus including the same according to a sixth embodiment of the invention will be described with reference to FIGS. 19 to 24. In addition, since the basic configuration and the entire configuration of the image forming apparatus of the embodiment are similar to the first embodiment, only the difference from the first embodiment will be described, and the same reference numeral will be given to the component having the same function as the first embodiment.

In all the above-described embodiments, in the thick sheet mode for the skew feeding correction, the skew feeding correction is performed on the sheet by the urging force of the shutter member and the sheet is caused to abut the nip portion of the second roller so as to perform the skew feeding correction. On the contrary, in the embodiment, in the thick sheet mode for the skew feeding correction, the skew feeding correction is performed only by the shutter member without using the configuration in which the sheet abuts the nip portion of the second roller 116. For that reason, the shutter member of the embodiment is provided so as to lock the rotation thereof.

<Shutter Regulation Portion>

Next, the configuration of a shutter regulation portion (a fixing portion) that switches the shutter member of the embodiment to a state where the sheet stopping portion is rotatable between the first posture and the second posture and a state where the sheet stopping portion is fixed to the first posture will be described.

Figure 19:
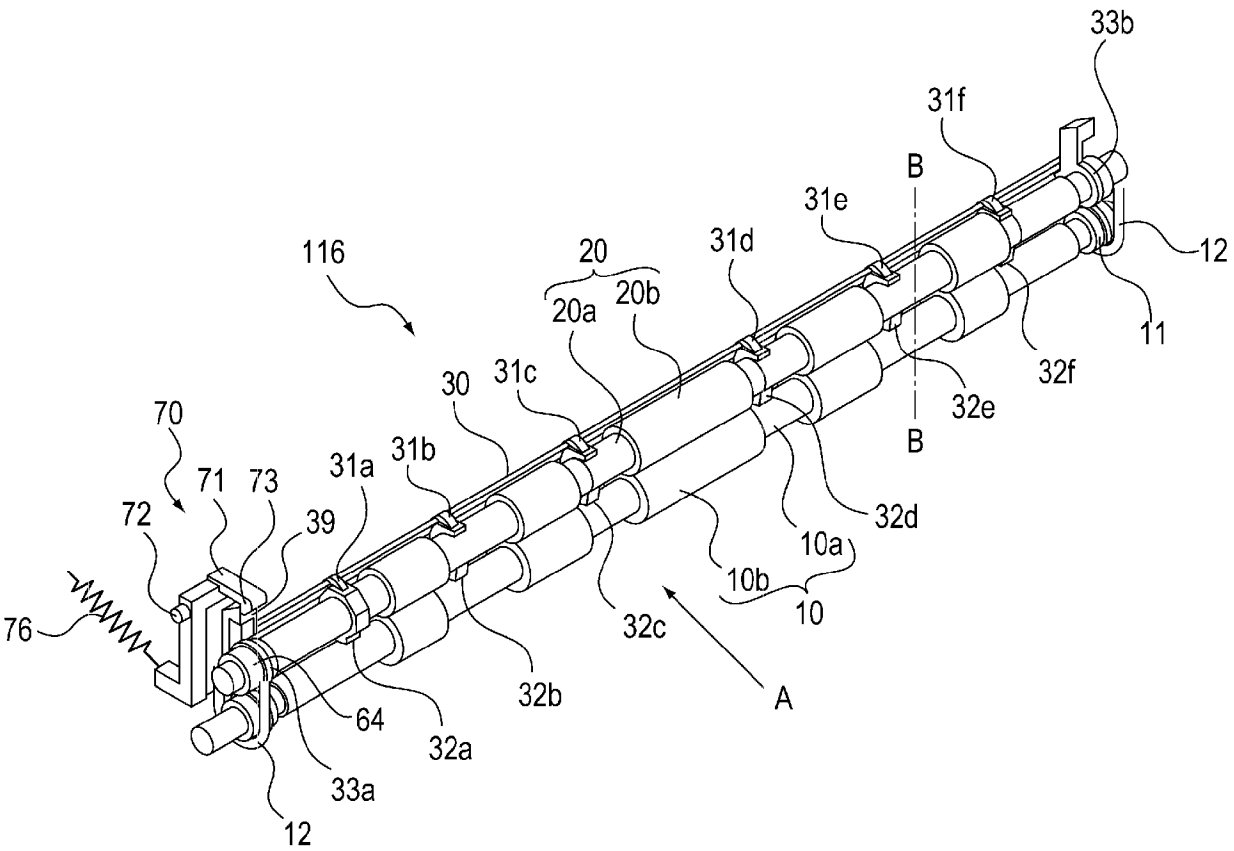
FIG. 19 is a perspective view illustrating a sheet skew feeding correction device according to a sixth embodiment.
Figure 20:
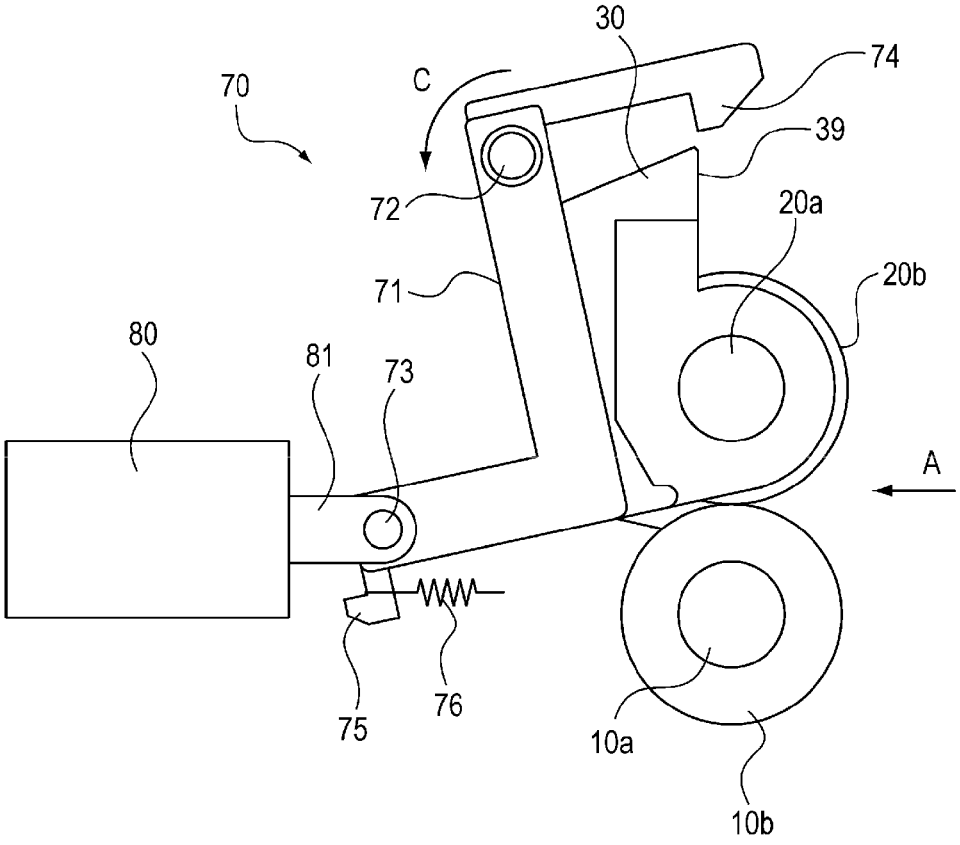
FIG. 20 is an explanatory diagram illustrating a sheet skew feeding correction device according to the sixth embodiment in a first mode.
Figure 21:
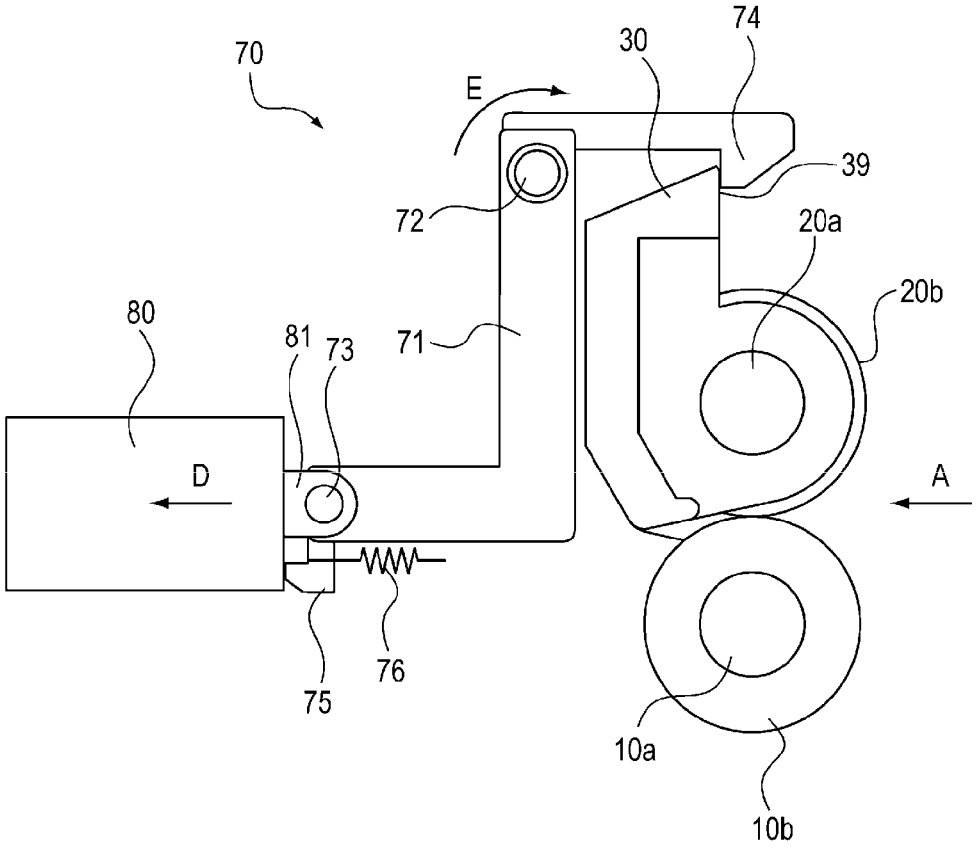
FIG. 21 is an explanatory diagram illustrating the sheet skew feeding correction device according to the sixth embodiment in a second mode.

FIG. 19 is a perspective view illustrating the configuration of the shutter member attached to the roller shaft of the second roller, FIG. 20 is an explanatory diagram illustrating a state where the sheet abutting portion 32 is rotatable, and FIG. 21 is an explanatory diagram illustrating a state where the rotation of the sheet abutting portion 32 is locked.

Figure 23:
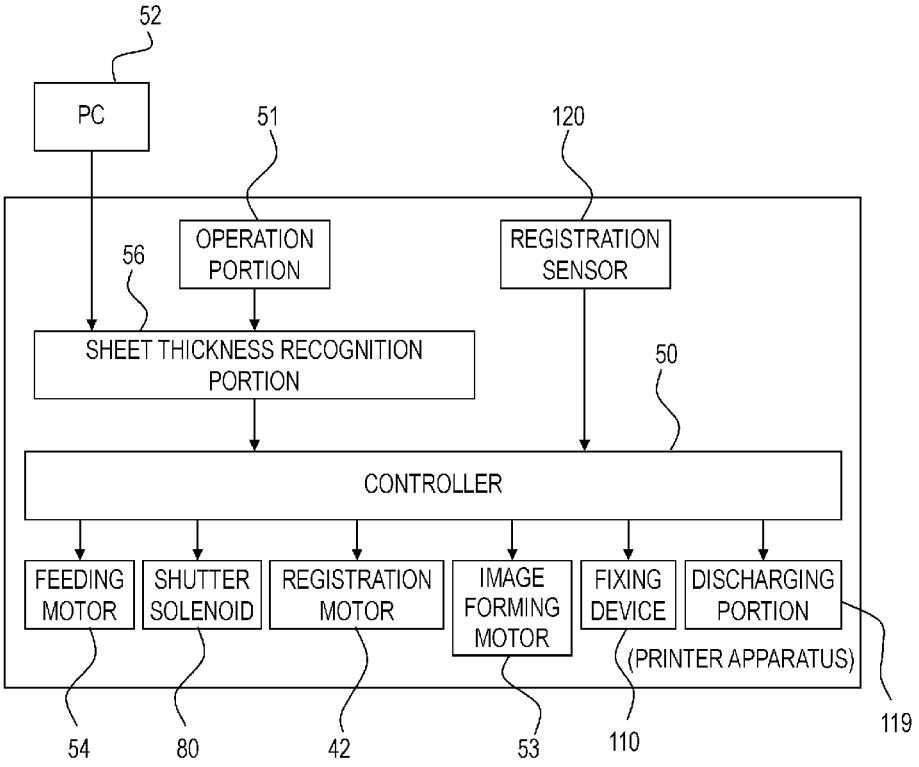
FIG. 23 is a block diagram illustrating the image forming apparatus according to the sixth embodiment.

As illustrated in the drawing, a shutter regulation member 71 is held by the frame (not illustrated) so as to be rotatable about the rotation shaft 72 as the rotation center. One end of the shutter regulation member 71 is provided with a connection portion 73 connected to a plunger 81 of a shutter solenoid 80, and the other end thereof is provided with a shutter locking portion 74 which engages with an engagement portion 39 of the shutter arm 30 so as to fix the shutter arm 30 in the first posture. As illustrated in FIG. 23, the shutter solenoid 80 is controlled by the controller 50 so as to be turned on or off, and serves as an operating portion that locks the shutter locking portion 74 to the shutter arm 30 or releases the locking operation.

An urging spring 76 is connected between a frame (not illustrated) and a spring hook portion 75 of the shutter regulation member 71. In a state where a current is not supplied to the shutter solenoid 80, the shutter regulation member 71 is urged in the direction of the arrow C of FIG. 20 by the urging spring 76 and is held in the posture of FIG. 20 by a stopper (not illustrated). In this state, the engagement between the shutter locking portion 74 of the shutter regulation member 71 and the engagement portion 39 of the shutter arm 30 is released, and hence the regulation piece 31 is rotatable between the first posture and the second posture of allowing the passage of the sheet.

When a current is supplied to the shutter solenoid 80 so that the plunger 81 of the shutter solenoid 80 is pulled in the direction of the arrow D of FIG. 21, the shutter regulation member 71 rotates about the rotation shaft 72 in the direction of the arrow E, and is held in the posture of FIG. 21 by the stopper (not illustrated). In this state, the shutter locking portion 74 of the shutter regulation member 71 engages with the engagement portion 39 of the shutter arm 30, and the regulation piece 31 abuts the leading end of the conveyed sheet so as to be fixed (locked) to the first posture of stopping the sheet leading end.

Next, the control operation of performing the sheet skew feeding correction by the shutter member with the above-described configuration will be described with reference to the flowchart of FIG. 22.

(Plain Paper)

When the feeding portion having a plain paper set therein is selected, the shutter arm 30 is rotatable without the locking operation of the shutter regulation member 71. When the sheet is conveyed in this state, the skew feeding of the sheet is corrected by the urging force of the shutter arm 30 similarly to the first embodiment, and the sheet is conveyed to the image forming portion by the second roller 116 (S1 to S23).

(Thick Sheet)

Meanwhile, when the feeding portion having a thick sheet set therein is selected and a current is supplied to the shutter solenoid 80 by the controller 50, as described above the regulation piece 31 of the shutter arm 30 is fixed to the first posture of stopping the sheet leading end by the shutter regulation member 71 (S24). In this state, the registration motor 42 is rotated so that the second roller 116 rotates in the sheet conveying direction at a half speed (a sheet conveying speed of 100 mm/s) (S25).

Further, the controller 50 rotates the registration motor 42 and sets the speed of the motors 53 driving the image forming portions such as the photosensitive drum, the intermediate transfer belt, and the developing sleeve so that the circumferential speed becomes a predetermined process speed (S26). That is, as described in the first embodiment, the image forming portions such as the photosensitive drum, the intermediate transfer belt, and the developing sleeve are driven at the circumferential speed of 75 mm/s (S26).

After the speed of the registration motor 42 and the motor driving the image forming portion is set, the image forming operation is started (S27).

Further, the feeding motor 54 starts to be driven at a predetermined timing so that the leading end position of the sheet as the transfer target matches the toner image on the intermediate transfer belt at the secondary transfer portion, and the sheet starts to be fed from the selected feeding portion (S28).

After the sheet is fed, the sheet is conveyed at a conveying speed (100 mm/s in the case of the plain paper) faster than the speed of the image forming portion.

When the sheet reaches the regulation piece 31 after the sheet passes by the sheet sensor 120 in front of the second roller (S29), the sheet leading end abuts the regulation piece 31 of which the rotation is locked, and hence the skew feeding caused by the above-described operation during the conveying operation is reliably corrected (S30). Then, when the skew feeding correction ends, the shutter member is rotatable while the supply of a current to the shutter solenoid 80 is prohibited by the controller 50 (S31).

In the embodiment, the first mode of evenly adjusting the sheet leading end by the urging force of the shutter member and the second mode of causing the sheet leading end to abut the fixed shutter member so as to perform the skew feeding correction are switched. Thus, even in the embodiment, it is possible to appropriately perform the skew feeding correction in response to the type of sheet similarly to the above-described embodiments.

Particularly in the case of the thick sheet, the sheet leading end abuts the shutter member so as to prevent the sheet from being bitten into the nip portion of the second roller. For this reason, high skew feeding correction ability can be obtained compared with the case where the skew feeding correction is performed only by the nip portion of the stopped second roller.

Further, since the sheet skew correction is not performed only by the urging force of the shutter, it is possible to handle the type of sheet having a wide range of thickness (basis weight). Accordingly, the user can obtain the sheet of which the skew feeding correction is sufficiently performed regardless of the type of sheet. Further, since there is no need to provide a drive system component used when the urging force of the shutter member is switched by the forward or backward rotation of the registration motor, the image forming apparatus can be decreased in cost and size.

(Sheet Thickness Sensor)

Figure 24:
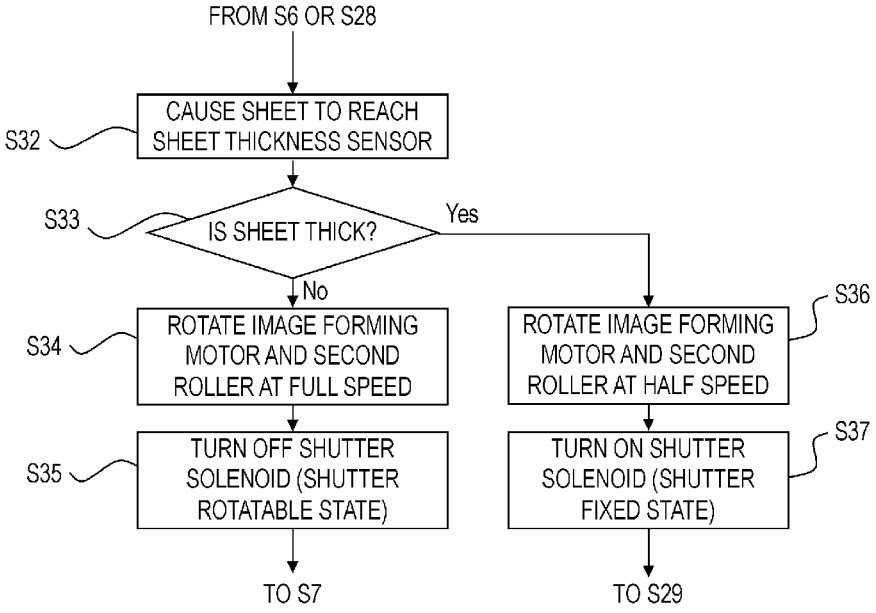
FIG. 24 is a flowchart illustrating a main print job of another example of the image forming apparatus according to the sixth embodiment.

In addition, even in the embodiment, as in the above-described embodiment, the thickness of the conveyed sheet is detected by the sheet thickness sensor 121, and the skew feeding correction mode can be automatically changed in response to the detection result. FIG. 24 is a flowchart for this configuration. Here, only the difference from the flowchart of FIG. 22 is illustrated.

Figure 22:
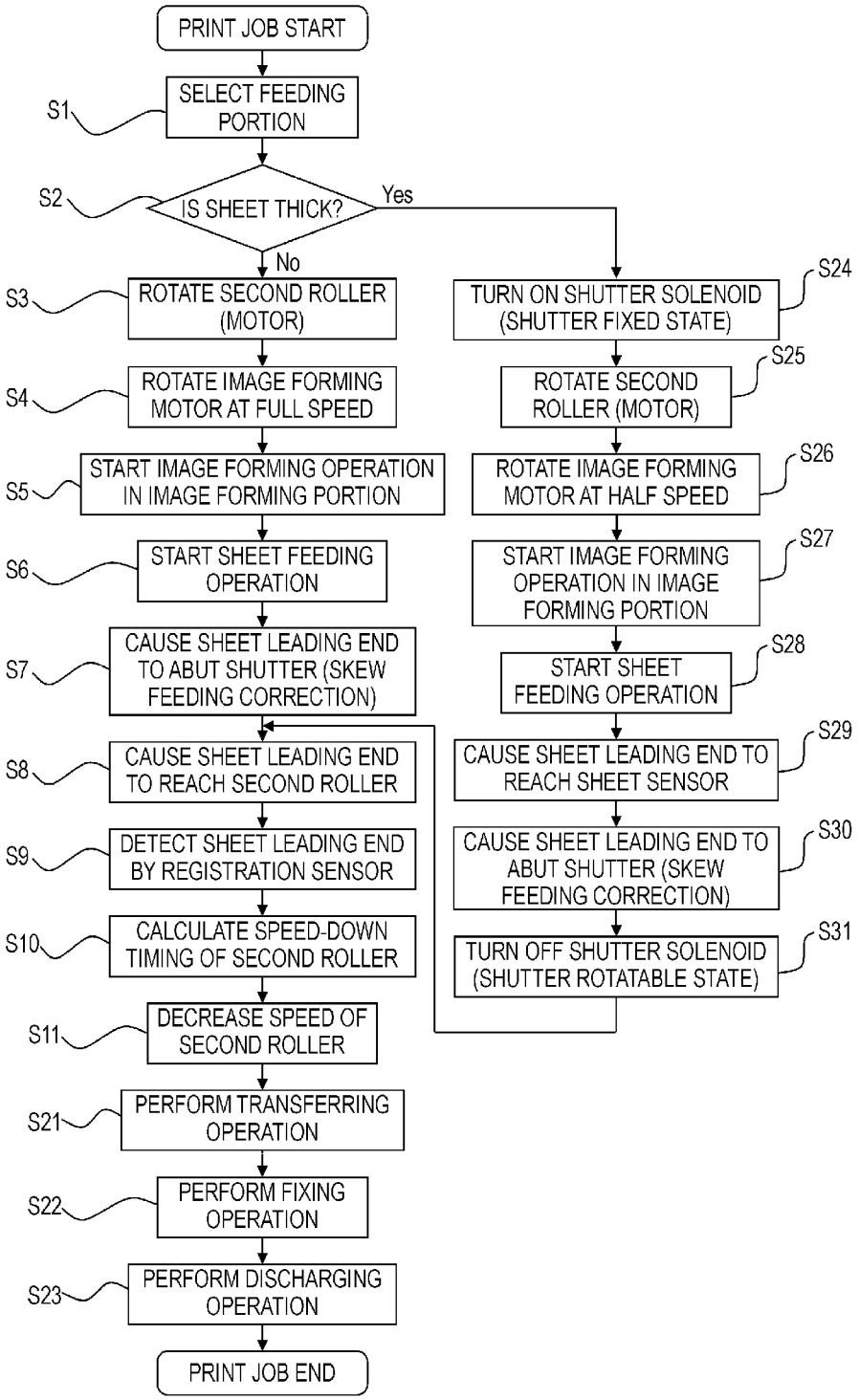
FIG. 22 is a flowchart illustrating a main print job of an image forming apparatus according to the sixth embodiment.

After step S6 or step S28 of FIG. 22, the sheet reaches the sheet thickness sensor 121 (S32). When it is determined that the sheet is the plain paper (S33), the image forming motor and the second roller 116 rotate at a full speed (S34), and the shutter solenoid 80 is turned off (S35). Then, the routine moves to step S7 of FIG. 22. Meanwhile, when it is determined that the sheet is the thick sheet (S33), the image forming motor and the second roller 116 are rotated at a half speed (S36), and the shutter solenoid 80 is turned on (S37). Then, the routine moves to step S29 of FIG. 22.

In this way, it is possible to obtain the sheet in which the skew feeding correction is sufficiently performed even by the user's mistake in which the sheet type different from the sheet type set by the feeding portions 111, 112, and 113 of the apparatus is input.

Seventh Embodiment

Next, a sheet conveying apparatus and an image forming apparatus including the same according to a seventh embodiment of the invention will be described with reference to FIGS. 25 to 28. Even in the embodiment, as in the sixth embodiment, the rotation of the shutter member is stopped in the thick sheet mode so as to perform the skew feeding correction, but the locking configuration of the shutter member is different from the sixth embodiment.

<Shutter Regulation Mechanism>

Figure 25:
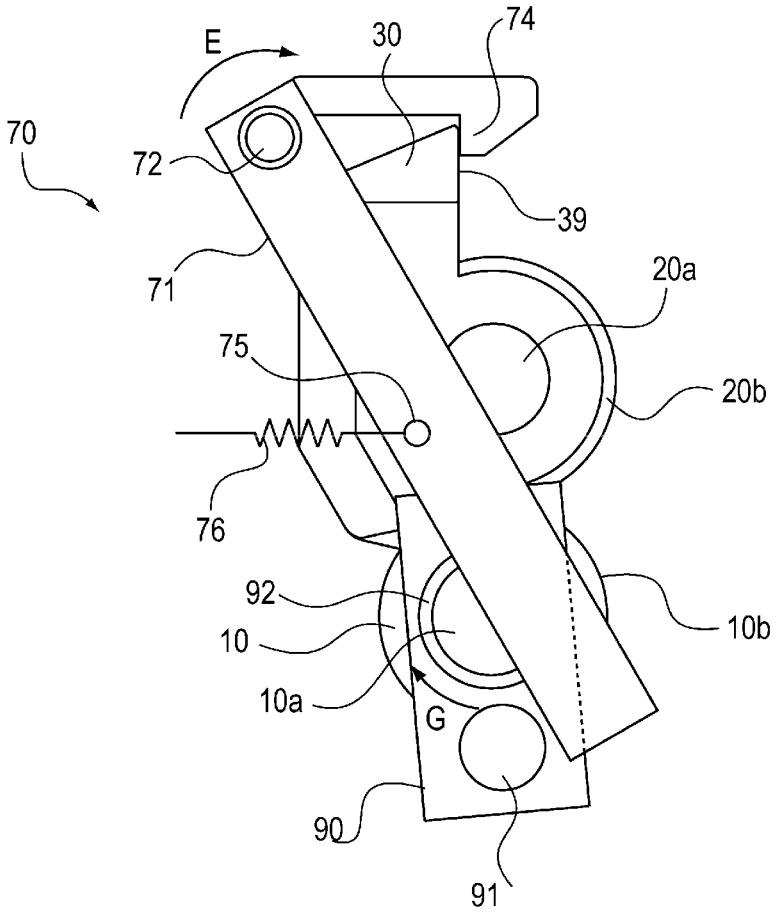
FIG. 25 is an explanatory diagram illustrating a sheet skew feeding correction device according to a seventh embodiment in a first mode.
Figure 26:
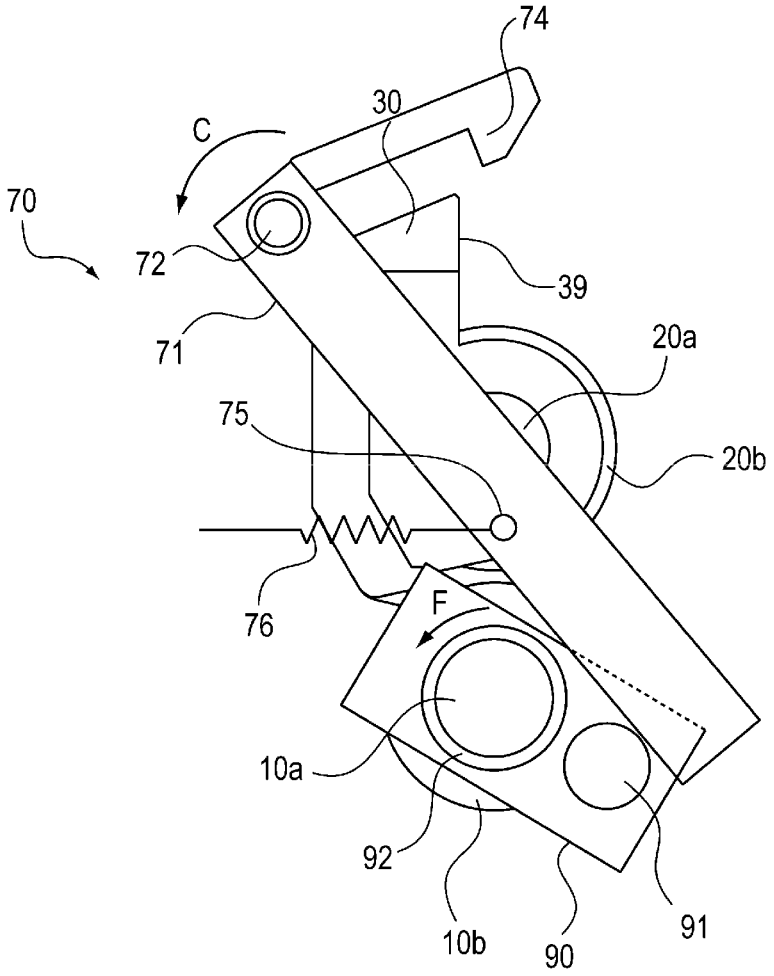
FIG. 26 is an explanatory diagram illustrating the sheet skew feeding correction device according to the seventh embodiment in a second mode.

FIG. 25 is a front view illustrating the second roller 116 constituting the sheet skew feeding correction device according to the embodiment in a state where the shutter member is locked. Further, FIG. 26 illustrates a state where the locking operation for the shutter member is released.

Since a shutter regulation lever 90 operates the shutter regulation member 71, it is possible to switch a state where the regulation piece 31 is fixed to the first posture of stopping the leading end of the conveyed sheet and a state where the regulation piece is rotatable between the first posture and the second posture of allowing the passage of the sheet.

The shutter regulation member 71 is held by a frame (not illustrated) so as to be rotatable about the rotation shaft 72 as the rotation center. One end of the shutter regulation member 71 is provided with the shutter locking portion 74 which engages with the engagement portion 39 of the shutter arm 30 so as to fix the shutter arm 30 in the first posture. Further, the other end of the shutter regulation member 71 is provided with the spring hook portion 75, and is connected to the urging spring 76 by the frame (not illustrated).

The shutter regulation lever 90 is rotatably attached to the shaft 10*a* of the lower roller through the torque limiter 92. The shutter regulation lever 90 is provided with a boss 91 which engages with the shutter regulation member 71.

When the lower roller 10 is stopped, the shutter regulation member 71 is rotated in the direction of the arrow E of FIG. 25 by the urging spring 76, and is held in the state of FIG. 25 by a stopper (not illustrated). In this state, the shutter locking portion 74 of the shutter regulation member 71 engages with the engagement portion 39 of the shutter arm 30, and the regulation piece 31 abuts the leading end of the conveyed sheet so as to be fixed in the first posture of locking the sheet leading end.

Meanwhile, when the lower roller 10 rotates in the sheet conveying direction, the shutter regulation lever 90 rotates in the direction of the arrow F of FIG. 26 through the torque limiter 92. Thus, when the boss 91 presses the shutter regulation member 71, the shutter regulation member 71 is rotated in the direction of the arrow C of FIG. 26 against the urging spring 76, and is held in the state of FIG. 26 by the stopper (not illustrated). In this state, the engagement between the shutter locking portion 74 of the shutter regulation member 71 and the engagement portion 39 of the shutter arm 30 is released, and the regulation piece 31 is rotatable between the first posture and the second posture of allowing the passage of the sheet.

Then, when the lower roller 10 is stopped after the sheet is conveyed, the shutter regulation member 71 is rotated in the clockwise direction of FIG. 26 by the urging force of the urging spring 76, and the shutter member is locked again. Accordingly, the shutter arm 30 can be locked in the first posture or the locking operation thereof can be released when the rotation of the lower roller 10 is allowed or prohibited.

<Description of Print Job and Skew Feeding Correction Mode Switching Operation>

Figure 27:
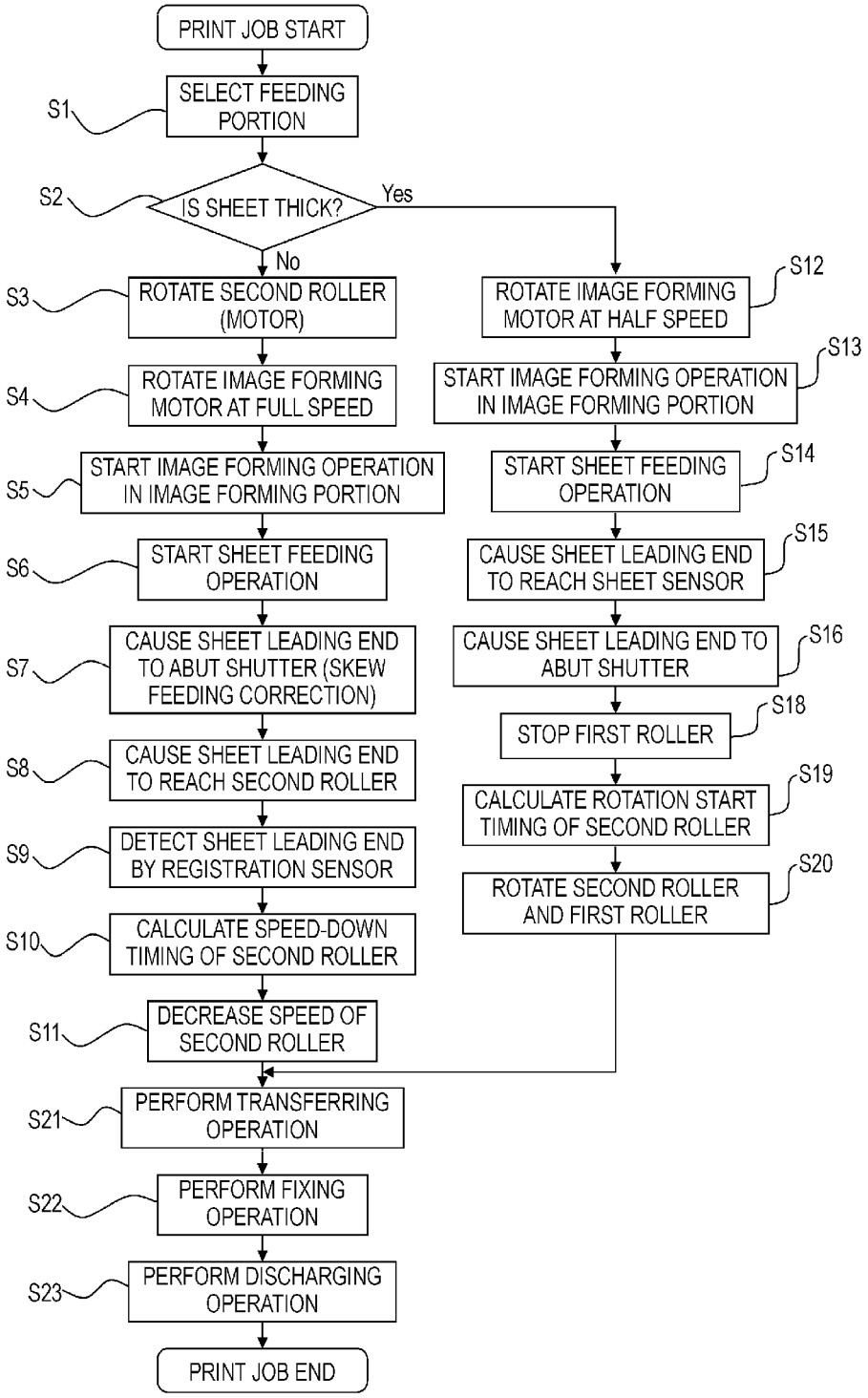
FIG. 27 is a flowchart illustrating a main print job of an image forming apparatus according to the seventh embodiment.

Next, a skew feeding correction mode switching operation in response to the type of sheet will be described. The procedure of the print job of the image forming apparatus according to the embodiment is illustrated in the flowchart of FIG. 27.

(Plain Paper)

When the feeding portion having a plain paper set therein is selected, the image forming motor is driven while the second roller 116 is rotated so as to start an image forming operation. When the second roller 116 is rotated, as described above, the regulation piece 31 is rotatable between the first posture and the second posture of allowing the passage of the sheet. Thus, similarly to the above-described embodiments, the skew feeding of the sheet is corrected by the urging force of the shutter member, and is conveyed to the image forming portion so as to transfer the toner image thereonto (S1 to S23).

(Thick Sheet)

When the feeding portion having a thick sheet set therein is selected, the controller 50 excites the registration motor 42 so that the second roller 116 is maintained in a stop state. Then, since the rotation of the shutter arm 30 is fixed as described above in the stop state of the second roller 116, the regulation piece 31 abuts the leading end of the conveyed sheet so as to be fixed in the first posture of stopping the sheet leading end.

Then, the routine proceeds from step S2 to step S12, and the procedure to step 15 is the same as the procedure of the first embodiment. That is, the motor 53 driving the image forming portion is rotated at a half speed so as to start the image forming operation and to start the sheet feeding operation (S12 to S14). Then, when the sheet passes by the sheet sensor 120 disposed at the front position of the second roller (S15) and reaches the regulation piece 31 of the shutter arm 30, the skew feeding corrected by the above-described operation during the conveying operation is corrected (S16).

Next, the controller 50 stops the feeding motor 54 so that the first roller 115 is stopped in the skew feeding correction state (S18). Then, the controller 50 calculates the rotation start timing of the second roller 116 so that the sheet leading end matches the leading end of the toner image on the intermediate transfer belt 106 by the secondary transfer portion 118 (S19), and drives the second roller 116 and the first roller 115 at that timing. Thus, as described above, the rotation locking state of the shutter arm 30 is released, and hence the regulation piece 31 is rotatable between the first posture and the second posture of allowing the passage of the sheet. As a result, the sheet is conveyed to the secondary transfer portion 118 in the skew feeding correction state (S20).

Subsequently, the toner image is transferred and fixed onto the sheet similarly to the first embodiment, and the print job ends (S21 to S23).

Even in the configuration of the embodiment, the same effect as the sixth embodiment can be obtained. Further, in the embodiment, there is no need to use the solenoid as in the sixth embodiment.

(Sheet Thickness Sensor)

Figure 28:
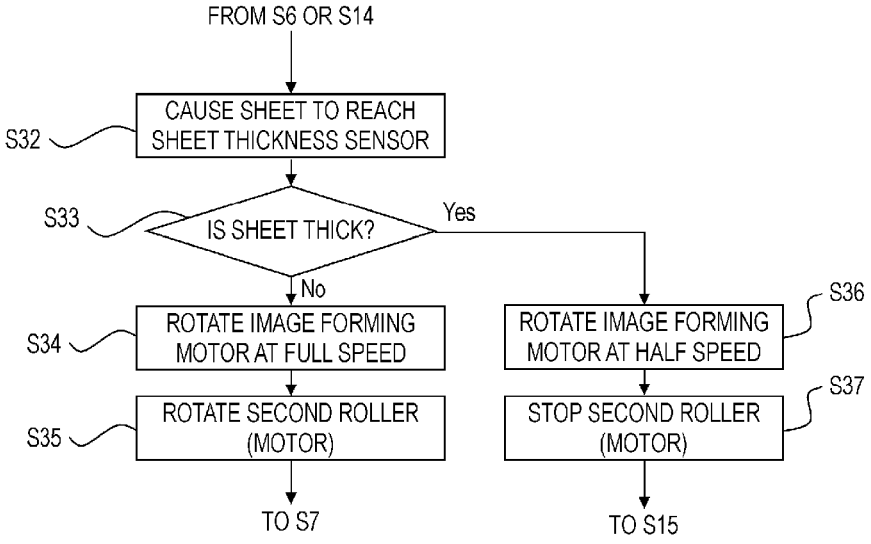
FIG. 28 is a flowchart illustrating a main print job of another example of the image forming apparatus according to the seventh embodiment.

In addition, even in the embodiment as in the above-described embodiment, the thickness of the conveyed sheet is detected by the sheet thickness sensor 121, and the skew feeding correction mode can be automatically switched in response to the detection result. FIG. 28 illustrates a flowchart for the above-described configuration, and only the difference from the flowchart of FIG. 27 is illustrated.

The sheet reaches the sheet thickness sensor 121 after step S6 or step S14 of FIG. 27 (S32). When it is determined that the sheet is the plain paper (S33), the image forming motor and the second roller 116 are rotated at a full speed (S34), and the routine moves to step S7 of FIG. 27. Meanwhile, when it is determined that the sheet is the thick sheet (S33), the image forming motor and the second roller 116 are rotated at a half speed (S36), and the second roller 116 is stopped (S37). Then, the routine moves to step S15 of FIG. 27.

In this way, it is possible to obtain the sheet in which the skew feeding correction is sufficiently performed even by the user's mistake in which the sheet type different from the sheet type set by the feeding portions 111, 112, and 113 of the apparatus is input.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-254695, filed Dec. 17, 2014, which is hereby incorporated by reference herein in its entirety.

What is claimed is:

1. A sheet skew feeding correction device comprising:

a first sheet conveying portion that conveys a sheet;

a second sheet conveying portion that is disposed on a downstream side of the first sheet conveying portion in a sheet conveying direction and conveys a sheet while nipping the sheet;

a moving member that includes a sheet stopping portion located at a position on an upstream side of a nip portion of the second sheet conveying portion in the sheet conveying direction so as to stop a leading end of the sheet and is movable between a first posture in which the sheet stopping portion stops the leading end of the sheet conveyed by the first sheet conveying portion and a second posture which allows the passage of the sheet;

an urging portion that urges the moving member so that the sheet stopping portion is in the first posture; and a controller configured to control the first sheet conveying portion and the second sheet conveying portion, and to perform a first mode in which the leading end of the sheet conveyed by the first conveying portion abuts the sheet stopping portion in the first posture and the sheet is nipped by the second conveying portion operating to convey the sheet while the sheet moves the sheet stopping portion toward the second posture against the urging force of the urging portion, and to perform a second mode in which the leading end of the sheet conveyed by the first conveying portion abuts the sheet stopping portion in the first posture, the sheet moves the sheet stopping portion against the urging force of the urging portion, and the leading end of the sheet abuts the nip portion of the stopped second sheet conveying portion so that a loop is formed in the sheet.

2. The sheet skew feeding correction device according to claim 1, wherein after the second mode, the second sheet conveying portion is operated so as to convey the sheet in a direction opposite to the sheet conveying direction, the sheet is returned to the upstream side of the nip portion of the second sheet conveying portion in the sheet conveying direction, and the sheet is conveyed by the second sheet conveying portion in the sheet conveying direction.

3. The sheet skew feeding correction device according to claim 1, wherein the moving member further includes a cam that is rotatable while being pressed by the sheet and the cam includes a plurality of sheet stopping portions provided at a predetermined interval in the rotation circumferential direction.

4. The sheet skew feeding correction device according to claim 1, wherein the controller switches the first mode and the second mode based on information of the thickness or the basis weight of the sheet.

5. The sheet skew feeding correction device according to claim 4, further comprising:

a sheet thickness detection portion that is disposed on the upstream of the second sheet conveying portion in the sheet conveying direction and detects the thickness of the sheet, wherein the controller switches the first mode and the second mode based on information on the thickness detected by the sheet thickness detection portion.

6. A sheet skew feeding correction device comprising:

a first sheet conveying portion that conveys a sheet;

a second sheet conveying portion that is disposed on a downstream side of the first sheet conveying portion in a sheet conveying direction and conveys a sheet while nipping the sheet;

a moving member that includes a sheet stopping portion located at a position on an upstream side of a nip portion of the second sheet conveying portion in the sheet conveying direction so as to stop the leading end of the sheet while abutting the leading end of the conveyed sheet and is movable between a first posture in which the sheet stopping portion stops the leading end of the sheet conveyed by the first sheet conveying portion and a second posture in which the sheet stopping portion allows the passage of the sheet;

an urging portion that urges the moving member so that the sheet stopping portion is in the first posture;

a movable fixing portion that fixes the sheet stopping portion in the first posture and is able not to fix the sheet stopping portion in the first posture so that the sheet stopping portion is movable between the first posture and the second posture; and a controller configured to control the first sheet conveying portion, the second sheet conveying portion, and the movable fixing portion, to perform a first mode in which the leading end of the sheet abuts the sheet stopping portion in the first posture while the sheet stopping portion is not fixed in the first posture by the movable fixing portion and the sheet moves the sheet stopping portion toward the second posture against the urging force of the urging portion and to perform a second mode in which the leading end of the sheet abuts the sheet stopping portion while the sheet stopping portion is fixed in the first posture by the movable fixing portion, the fixing operation of the sheet stopping portion is released, and the sheet moves the sheet stopping portion to the second posture against the urging force of the urging portion.

7. The sheet skew feeding correction device according to claim 6, wherein the movable fixing portion includes a locking portion that is locked to the moving member so as to regulate the movement of the moving member and an operating portion that is operated so as to lock the locking portion to the moving member or release the locking operation.

8. The sheet skew feeding correction device according to claim 7, wherein the operating portion is operated by a solenoid.

9. The sheet skew feeding correction device according to claim 6, wherein the movable fixing portion is configured so that the sheet stopping portion to be movable between the first and second postures when the second sheet conveying portion is operated in the sheet conveying direction and so that the sheet stopping portion to be fixed in the first posture when the second sheet conveying portion is stopped.

10. The sheet skew feeding correction device according to claim 6, wherein the controller switches between the first mode and the second mode based on information of the thickness or the basis weight of the sheet.

11. An image forming apparatus comprising:

a first sheet conveying portion that conveys a sheet;

a second sheet conveying portion that is disposed on a downstream side of the first sheet conveying portion in a sheet conveying direction and conveys a sheet while nipping the sheet;

an image forming portion that forms an image on the sheet conveyed by the second sheet conveying portion;

a moving member that includes a sheet stopping portion located at a position on an upstream side of a nip portion of the second sheet conveying portion in the sheet conveying direction so as to stop the leading end of the sheet and is movable between a first posture in which the sheet stopping portion stops the leading end of the sheet conveyed by the first sheet conveying portion and a second posture which allows the passage of the sheet;

an urging portion that urges the moving member so that the sheet stopping portion is in the first posture; and a controller configured to control the first sheet conveying portion and the second sheet conveying portion, and to perform a first mode in which the leading end of the sheet conveyed by the first conveying portion abuts the sheet stopping portion in the first posture and the sheet is nipped by the second conveying portion operating to convey the sheet while the sheet moves the sheet stopping portion toward the second posture against the urging force of the urging portion, and to perform a second mode in which the leading end of the sheet conveyed by the first conveying portion abuts the sheet stopping portion in the first posture, the sheet moves the sheet stopping portion against the urging force of the urging portion, and the leading end of the sheet abuts the nip portion of the stopped second sheet conveying portion so that a loop is formed in the sheet.

12. A sheet conveying apparatus comprising:

a conveying portion that conveys a sheet;

a pair of rotating members that is disposed on a downstream side of the conveying portion in a sheet conveying direction and which conveys the sheet while nipping the sheet at a nip portion;

a movable moving member that includes a sheet stopping portion disposed on a upstream side of the nip portion of the pair of rotating members in the sheet conveying direction so as to stop the leading end of the conveyed sheet;

an urging portion that urges the moving member toward a position where the leading end of the sheet abuts the sheet stopping portion; and a controller configured to perform a first mode in which the sheet is nipped by the pair of rotating members being rotating while the leading end of the sheet conveyed by the conveying portion moves the moving member against the urging force of the urging portion and to perform a second mode in which the leading end of the sheet abuts the pair of rotating members being stopped while the leading end of the sheet conveyed by the conveying portion moves the moving member against the urging force of the urging portion.

13. The sheet conveying apparatus according to claim 12, wherein the controller switches the first mode and the second mode based on information of the type of sheet.

* * * * *